US007455081B2

(12) United States Patent
Bacnik

(10) Patent No.: US 7,455,081 B2
(45) Date of Patent: Nov. 25, 2008

(54) HOLDER FOR AN ELECTRONIC PRICE LABEL

(75) Inventor: James A. Bacnik, Mentor, OH (US)

(73) Assignee: Fasteners for Retail, Inc., Cleveland, OH (US)

( * ) Notice: Subject to any disclaimer, the term of this patent is extended or adjusted under 35 U.S.C. 154(b) by 10 days.

(21) Appl. No.: 10/799,563

(22) Filed: Mar. 11, 2004

(65) Prior Publication Data

US 2004/0178308 A1 Sep. 16, 2004

(51) Int. Cl.
*G09F 3/18* (2006.01)

(52) U.S. Cl. ..... 140/661.03; 40/642.02

(58) Field of Classification Search ..... 40/661.03, 40/642.02; D20/43, 44
See application file for complete search history.

(56) References Cited

U.S. PATENT DOCUMENTS 4,532,726 A 8/1985 Kenney
D291,097 S * 7/1987 Dalbey et al. ..... D20/44
5,375,357 A 12/1994 Butcher et al.
5,392,547 A * 2/1995 Mason ..... 40/661.06
5,473,833 A 12/1995 Ostrovsky
5,553,412 A 9/1996 Briechle et al.
5,575,100 A 11/1996 Marvin et al.
5,611,512 A 3/1997 Cholet
5,715,622 A 2/1998 Giordano, Jr.
5,791,080 A 8/1998 Hamano
5,816,550 A 10/1998 Watanabe et al.
5,899,011 A * 5/1999 Brinkman ..... 40/661.03
6,035,569 A 3/2000 Nagel et al.
6,119,990 A 9/2000 Kump et al.
6,142,322 A * 11/2000 Smith et al. ..... 211/183
6,357,154 B1 * 3/2002 Pfendler et al. ..... 40/661.03
6,553,702 B1 4/2003 Bacnik
D482,404 S * 11/2003 McIlvaine ..... D20/43
D482,406 S * 11/2003 McIlvaine ..... D20/43
D482,733 S * 11/2003 McIlvaine ..... D20/43
6,935,062 B2 * 8/2005 Lowry et al. ..... 40/661.03

FOREIGN PATENT DOCUMENTS

WO WO 93/19448 9/1993
WO WO 9319448 A1 * 9/1993

OTHER PUBLICATIONS

FFR Yellow Pages 2003 Product Catalog, cover page and p. 46.
HL Display 1995 Catalog, cover page, pp. 36-41.

* cited by examiner

*Primary Examiner*—Cassandra Davis
(74) *Attorney, Agent, or Firm*—Fay Sharpe LLP

(57) ABSTRACT

A holder for an electronic price label (EPL) includes a channel member defined by a base wall and first and second spaced-apart side walls that project outwardly from opposite ends of the base wall. The base wall and the side walls define a somewhat C-shaped recess in the channel member. An associated EPL is adapted for receipt in the recess. A clip is connected to the channel member and is adapted for releasable connection to a wide variety of different retail shelf fixtures. In one embodiment, the clip is connected to a back wall that is interconnected with the channel member in different ways to define a variety of cross-sectional shapes. In another embodiment, the clip cooperates with a top wall to define a slot therebetween that receives and retains a front edge of an associated retail shelf. In still another embodiment, the clip includes top and bottom sections that cooperate with a back wall.

24 Claims, 21 Drawing Sheets

HOLDER FOR AN ELECTRONIC PRICE LABEL

BACKGROUND OF THE INVENTION

The present invention relates to a holder for an electronic price label (EPL) and, more particularly, a holder for an EPL which is cost-effective, convenient to manufacture, and adapted for secure attachment to a wide variety of retail shelving in a manner which facilitates convenient viewing of an associated EPL.

EPL's and holders therefor are widely known. They are described, for example, in U.S. Pat. Nos. 5,553,412; 5,791,080; 5,816,550; and 5,611,512. However, prior holders for EPL's have been found to be deficient for a wide variety of reasons. Some are simply too complicated and, consequently, expensive and difficult to manufacture. Others are not well-suited for connection to a wide variety of different shelving types as are commonly found in the retail industry and/or require use of separate fasteners. Still others are prone to becoming dislodged when inadvertently contacted by consumers and others. For these and other reasons, there exists a need for a new and improved holder for an EPL which is convenient to manufacture, cost-effective, suitable for use with a large number of different types of retail shelving, and which securely affixes an associated EPL in a desired location relative to a retail shelf without use of fasteners and in a manner which facilitates EPL viewing but resists dislodgement due to inadvertent contact.

SUMMARY OF THE INVENTION

In accordance with the present invention, an extruded holder for an electronic price label (EPL) includes a channel member defined by a base wall and first and second spaced-apart side walls that project outwardly from opposite ends of the base wall with respective first and second inner faces arranged in opposed facing relation. The base wall and the side walls define a C-shaped recess in the channel member. An associated EPL is adapted for receipt in the C-shaped recess. A clip is connected to the channel member and is adapted for releasable connection to a wide variety of different retail shelf fixtures. The clip is defined by a base member and a back member interconnected to define an opening. The clip is further defined by a connecting arm that has a first end connected to the clip and a second end connected to the channel member.

In accordance with another aspect of the present invention, a transparent viewing lens is provided and placed in selective covering relation with an EPL positioned in the channel. The lens can be removably connected to the channel member or pivotably connected to the EPL holder and adapted for selective movement between an opened and closed position.

Still other benefits and advantages of the present invention will become apparent to those of ordinary skill in the art upon a reading and understanding of the following specification.

BRIEF DESCRIPTION OF THE DRAWINGS

The invention may take physical form in certain parts and arrangements of parts, several preferred embodiments of which are described in the specification and illustrated in the accompanying drawings which form a part hereof and wherein.

DETAILED DESCRIPTION OF THE INVENTION

Figure 1A:
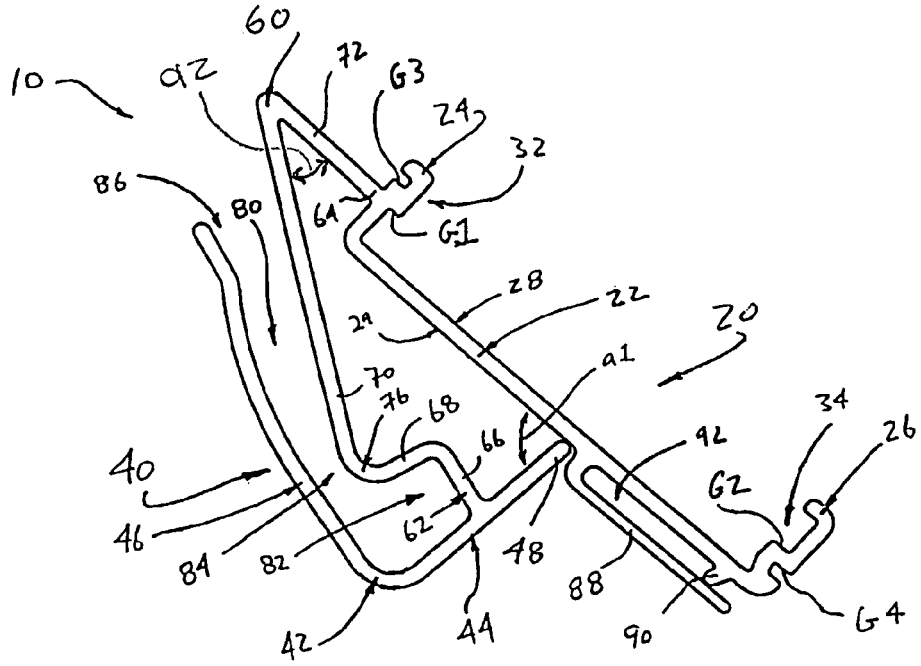
FIG. 1A is a side elevational view of a holder for a first type of electronic price label (EPL) formed in accordance with a first embodiment of the present invention.

With reference now to FIG. 1A a holder for an electronic price label (EPL) or the like is illustrated at 10. The holder 10 is formed in accordance with the present invention from polyvinyl chloride plastic or any other suitable plastic by extrusion, molding, or any suitable plastic forming technique. The holder 10 can be an extrusion having the profile as shown in FIG. 1A.

Figure 1B:
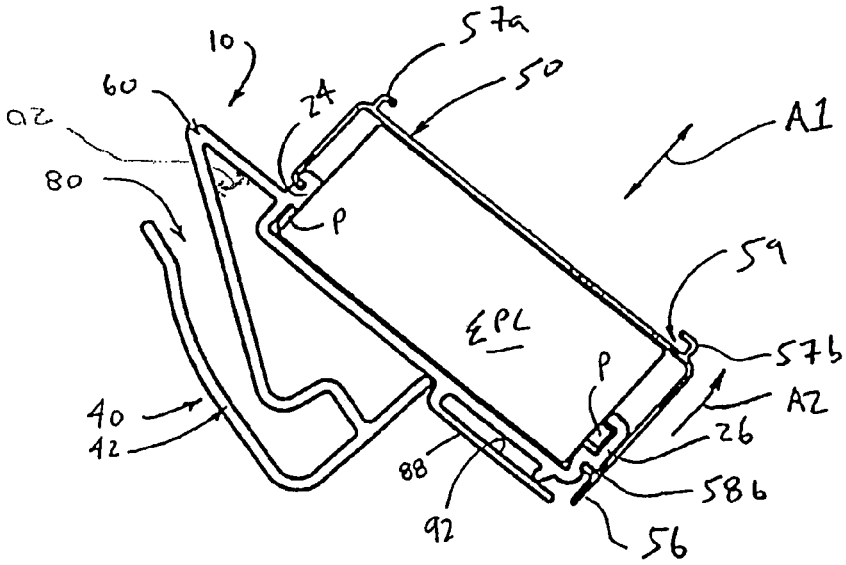
FIG. 1B is a reduced side elevational view of the holder of FIG. 1A as used to secure an associated EPL in an operative position and including an associated protective viewing lens positioned in covering relation with the EPL.

The holder 10 includes a base channel 20 having an overall C-shape conformation to slidably accommodate and frictionally retain an associated electronic price label (EPL) as seen in FIG. 1B. The C-channel is defined by a base wall 22 which is preferably planar, and top and bottom walls 24,26, also referred to as first and second side walls, respectively. The top and bottom walls 24,26 project outwardly from a front face 28 of the base wall 22, preferably a like distance and substantially perpendicular to the base wall 22. Thus, the top and bottom walls 24,26 are arranged generally parallel to each other to accommodate an associated EPL in the recess defined therebetween and together with the base wall 22.

The opposed, inward faces 32, 34 of the top and bottom walls 24, 26, respectively, include grooves G1, G2 which accommodate projections P extending outwardly from the associated EPL positioned in the C-channel 20. This construction allows an associated EPL to be inserted and removed from the recess defined in the C-channel 20 by sliding and/or by movement of the EPL in a direction toward and away from the base wall 22 (as indicated by the arrow Al in FIG. 1B).

The holder 10 further comprises a clip portion 40 connected to the C-channel 20 by way of the top wall 24. The clip portion 40 is adapted to secure the holder 10 to an associated shelf (not illustrated). More particularly, the shelf attachment clip portion 40 comprises an L-shaped resilient member 42 having a base 44 and an upwardly projecting back portion 46.

The L-shaped clip 40 and the C-channel 20 are resiliently interconnected byway of a connecting arm 60. The arm 60 comprises a first end 62 connected to the base 44 of the L-shaped member 42 and a second end 64 connected to the top wall 24 of the C-channel 20 so that the arm 60 is at least partially positioned between the back portion 46 of the L-shaped clip 40 and the C-channel 20.

More particularly, the connecting arm 60 includes a first segment 66 projecting upwardly from the base member 44 of the L-shaped clip 40 in the same general direction as the upwardly projecting back portion 46 of the L-shaped clip. A second segment 68 of the connecting arm 60 extends toward the back portion 46 of the L-shaped clip 40, and a third segment 70 once again extends upwardly away from the base 44 of the clip 40. Finally, a fourth segment 72 connects the arm 60 to the top wall 24 of the C-channel 20. It can be seen that the connecting arm 60 is thus formed with an L-shaped bend 76 which protrudes toward the back portion 46 of the L-shaped clip 40. The L-shaped clip portion 40 and the connecting arm 60 thus define an upwardly open slot or channel 80 therebetween. The innermost closed end 82 of the slot 80 is enlarged.

The bend 76 of the connecting arm 60 and the back portion 46 of the clip 40 define therebetween a restricted portion 84 of the slot 80. The open end or mouth 86 of the slot 80 is preferably defined between the connecting arm 60 and an uppermost portion of the L-shaped clip back 46 which diverges from the connecting arm 60 so as to facilitate insertion of a shelf therein for attachment of the holder 10 thereto. Therefore, the slot 80 is also defined with an overall L-shaped configuration.

A mounting angle a1 is defined between the L-shaped clip base wall 44 and the C-channel base wall 22 by abutment of a rear face 29 of the base wall 22 with an innermost tip 48 of the L-shaped clip 40 so that the C-channel 20 is rearwardly inclined relative to vertical by a select angle (approximately 45°) when in its operative position. The tip 48 is not connected to the base wall 22. This facilitates extrusion of the holder and allows for limited movement of the C-channel 20 away from the clip portion 40 as allowed by the resilience of the connecting arm 60 (as indicated by the arrow a2) to absorb and accommodate shocks by a shopper removing items from the associated retail shelf to which the holder 10 is attached or the shelf beneath the one to which the holder is attached. Those of ordinary skill in the art will recognize that the angle a1 may be varied to define different viewing angles of the C-channel relative to a vertical plane.

A resilient finger 88 projects from the rear face 29 of the base wall 22 and extends generally parallel to the base wall 22 in a direction toward the second side wall 26. The finger contacts a nib 90 projecting from the rear face 29 in the region of the second side wall 26 so that a closed slot 92 is defined between the finger 88 and the rear face 29. An advertising flyer or the like (not illustrated) is selectively secured in the slot 92 by insertion of same between the finger 88 and the nib 90 where it is frictionally or otherwise retained.

The holder 10, due to its rearward inclination relative to vertical, is particularly adapted for a connection to an associated shelf S at a level below that of a viewer's eye level. Of course, those of ordinary skill in the art will recognize that the C-channel 20 can be arranged at any of a wide variety of other desired angles a, relative to the clip portion 40 so that the C-channel 20 defines other viewing angles relative to vertical without departing from the overall scope and intent of the present invention.

Figure 2A:
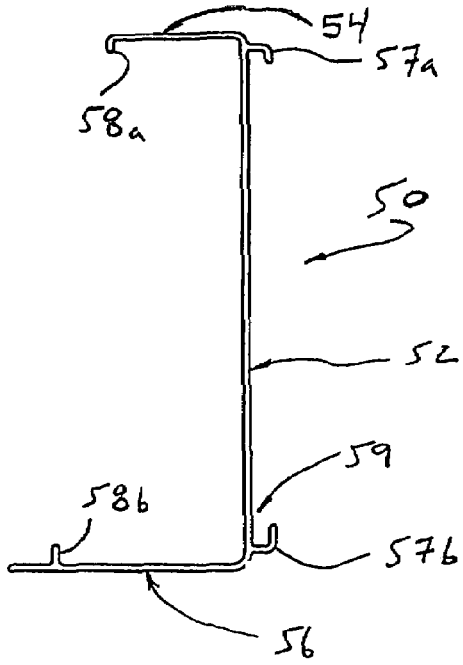
FIGS. 2A-2E are respective side elevational views of five types of protective viewing lenses formed in accordance with the present invention.

With reference now also to FIG. 2A, a protective viewing lens 50 formed in accordance with the present invention is illustrated. The lens 50 is made from clear polyvinyl chloride or other clear plastic material, preferably extruded with the illustrated profile. More particularly, the lens 50 comprises a planar viewing wall 52, a first or upper side wall 54, and a second or lower side wall 56. First and second ribs 58*a*, 58*b* project inwardly toward each other from the side walls 54, 56, respectively. As illustrated in FIG. 1B, the lens 50 is adapted for placement in covering relation with respect to the EPL secured to the C-channel 20 of the holder 10. When the lens 50 is so positioned, the ribs 58*a*, 58*b* are received in grooves G3, G4, formed in the outwardly facing surfaces of the holder side walls 24, 26, respectively. The receipt of the ribs 58*a*, 58*b* in the grooves G3, G4 fixedly secures the lens 50 in its operative position relative to the holder 10.

The lens 50 also includes first and second L-shaped fingers 57*a*, 57*b* which project outwardly from the viewing wall 52 in a direction opposite the lens side walls 54, 56. The L-shaped fingers are arranged to define therebetween a slot 59 for receipt of printed matter or the like (not illustrated) to be viewed in association with the price and other information displayed by the associated EPL.

Figure 2B:
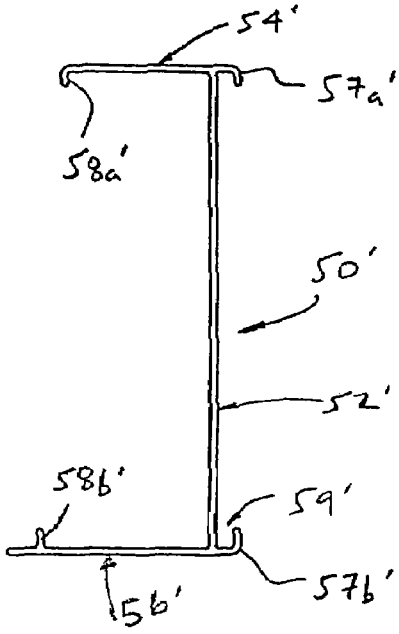

With reference to FIG. 2B, a protective viewing lens formed in accordance with a second embodiment is illustrated. Like components are identified with like numerals including a primed (') suffix. A lens 50' is preferably extruded from a transparent plastic material to have the profile illustrated in FIG. 2B. More particularly, the lens 50' comprises a planar viewing wall 52', a first or upper side wall 54', and a second or lower side wall 56'. First and second ribs 58*a*', 58*b*' project inwardly toward each other from the side walls 54', 56', respectively.

The lens 50' also includes first and second L-shaped fingers 57*a*', 57*b*', which project outwardly from the viewing wall 52' in a direction opposite the lens side walls 54', 56'. The L-shaped fingers are arranged to define therebetween a slot 59' for receipt of printed matter or the like to be viewed in association with the price and other information displayed by the associated EPL. The viewing lens 50' is placed in selective covering relation with an electronic price label and connects to a holder in the same manner that the lens 50 connects to the holder 10, i.e. through cooperation of the ribs 58*a*', 58*b*' and associated grooves. However, the slot 59' is dimensioned differently than is slot 59 of the lens 50.

Figure 2C:
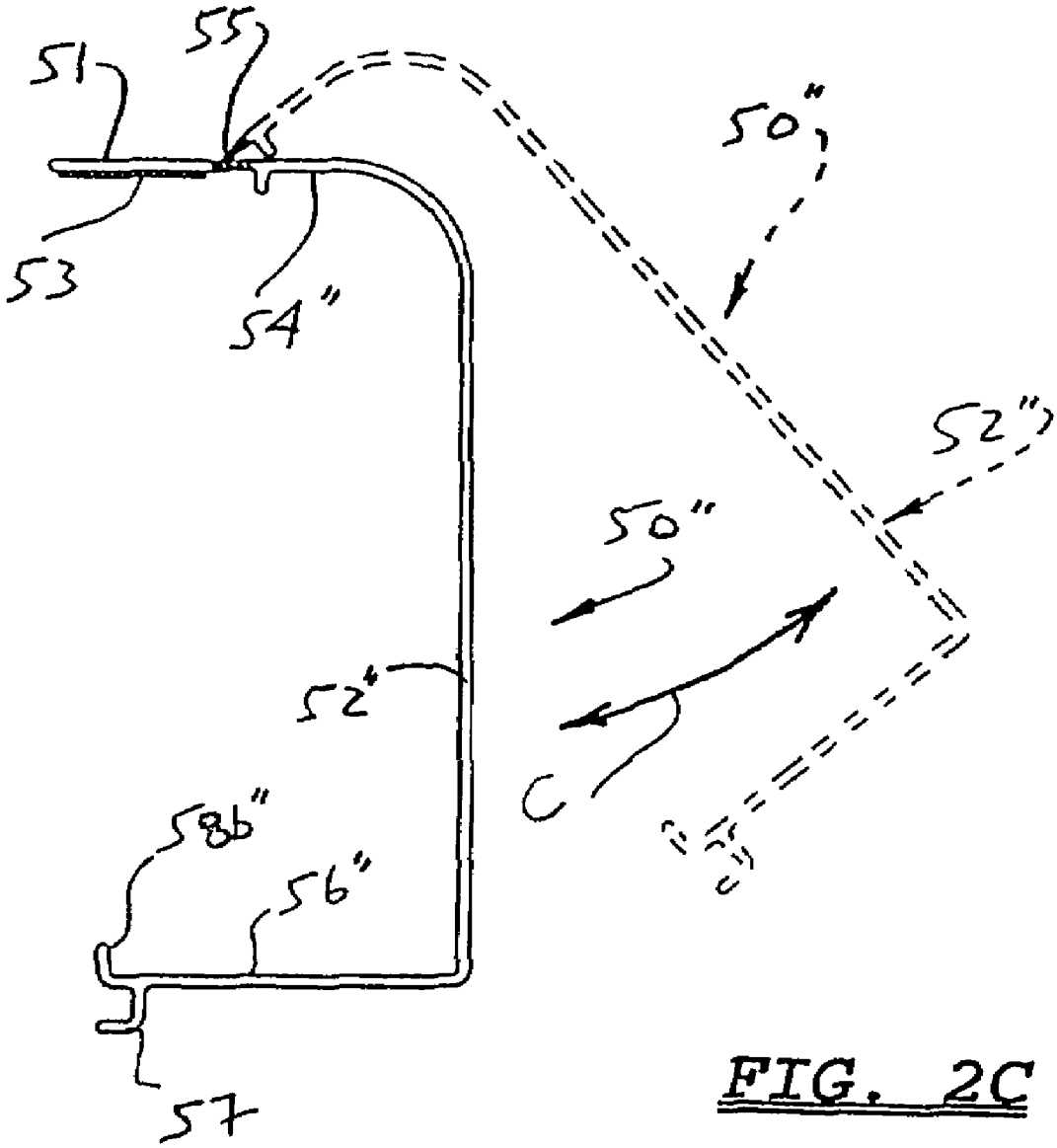

With reference now to FIG. 2C, a third type of protective viewing lens is there illustrated. Like components are illustrated by like numerals with a double-primed (") suffix and new components are illustrated by new numerals. A lens 50" is preferably extruded from a transparent plastic material to have the profile illustrated in FIG. 2C. Unlike the lenses 50, 50', the lens 50" is not adapted to releasably engage an associated holder such as the holder 10 illustrated in FIG. 1B. Instead, the lens 50" comprises a mounting portion 51 that includes an adhesive 53 such as a pressure-sensitive adhesive tape or the like on a face thereof. Thus, the mounting portion 51 is adapted for being fixedly secured to an associated holder. The lens 50" also comprises a viewing wall 52" that is connected to the mounting portion 51 by way of a living hinge 55 that can be formed as a one-piece construction with the mounting portion 51 and viewing wall 52" or that can be provided by a length of tape of other material. The mounting portion 51 of the lens 50" is secured to an associated holder in a position so that the viewing wall 52" is adapted for pivoting movement on an arc C between a closed position (illustrated in solid lines in FIG. 2C) wherein the viewing wall is placed in covering relation with an associated electronic price label secured to a holder, and an open position (illustrated in broken lines in FIG. 2C) wherein the viewing wall moved away from an associated electronic price label allowing access to same. In the closed position, the finger 58*b*" engages a side wall of a holder so that the lens is resistant to movement from its closed position to its open position. Preferably, a rib 57 is provided and projects outwardly from the side wall 56" of the lens 50" to facilitate manual grasping of the viewing wall 52" for purposes of moving same to its open position. Those of ordinary skill in the art will recognize that the adhesive 53 and the living hinge 55 cooperate to prevent spilled liquids from contacting an associated electronic price label.

Figure 2D:
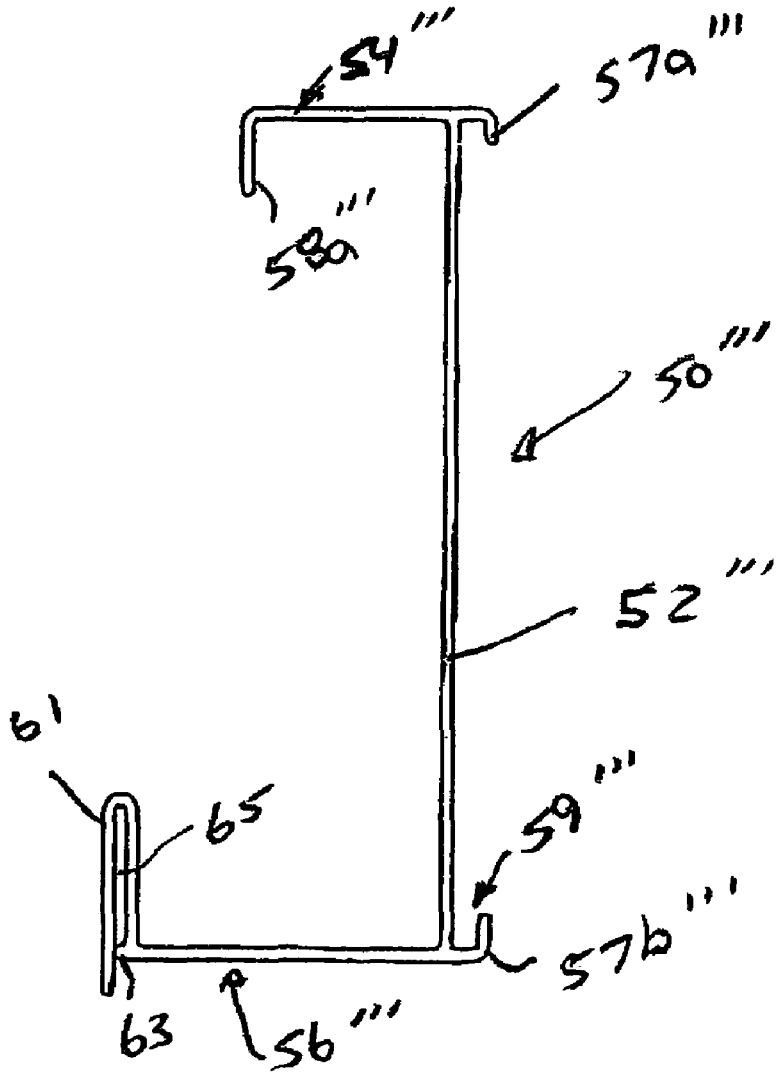

With reference now to FIG. 2D, a fourth type of protective viewing lens formed in accordance with the present invention is illustrated. In this embodiment, like components are identified by like numerals having a triple-primed (''') suffix and new components are identified by new numerals. A lens 50''' is preferably extruded from a transparent plastic material to have the profile illustrated in FIG. 2D. The lens 50''' comprises a planar viewing wall 52''', a first or upper side wall 54''' and a second or lower side wall 56'''. A first rib 58*a*''' projects inwardly from the upper side wall 54'''. A resilient finger 61 projects inwardly from the lower side wall 56''' and extends generally parallel to the planar viewing wall 52'''. The finger 61 contacts a nib 63 projecting from the end of side wall 56''' so that a closed slot 65 is defined by the finger 61 and the nib 63. An advertising flyer or the like (not illustrated) can be selectively secured in the slot 65 by insertion of same between the finger 61 and the nib 63 where it is frictionally or otherwise retained.

The lens 50''' also includes first and second L-shaped fingers 57*a*''', 57*b*''', which project outwardly from the viewing wall 52''' in a direction opposite the lens side walls 54''', 56'''. The L-shaped fingers 57*a*''', 57*b*''' are arranged to define therebetween a slot 59''' for receipt of printed matter or the like to be viewed in association with the price and other information displayed by the associated EPL.

Figure 2E:
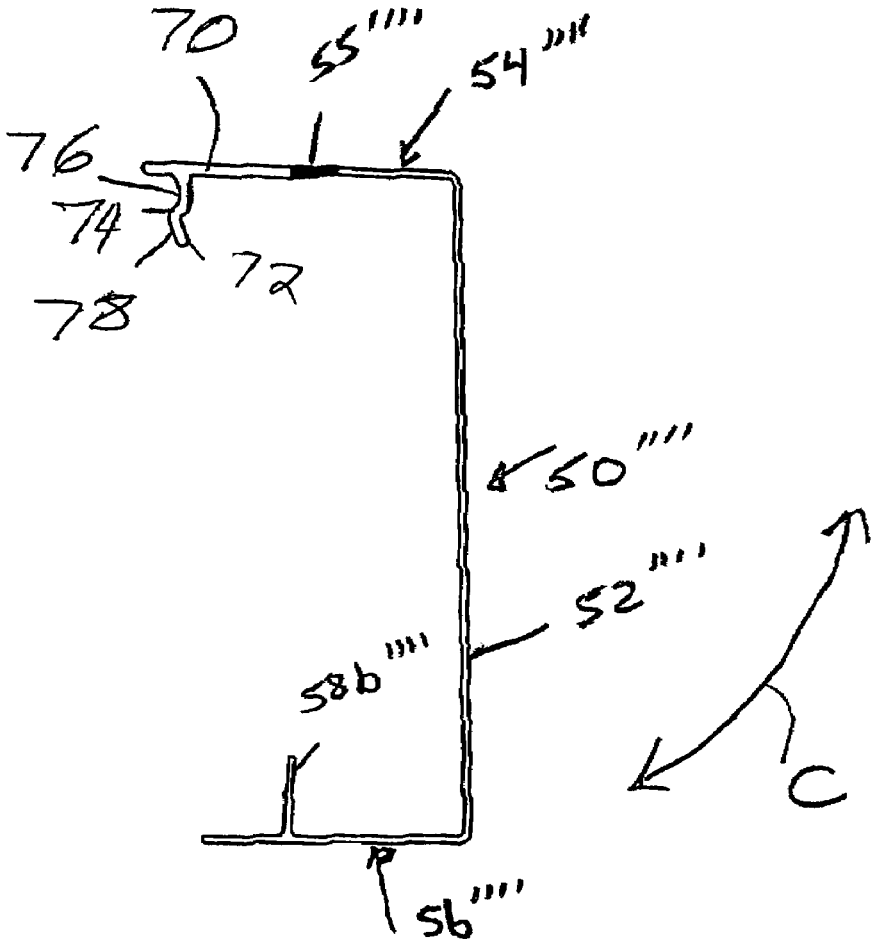

With reference now also to FIG. 2E, a fifth type of protective viewing lens formed in accordance with the present invention is illustrated. In this embodiment, like components are identified with like reference numbers including a quadruple-primed ("") suffix and new components are identified by new numerals. A lens 50"" comprises a mounting portion 70 that includes a Z-shaped first rib 72. More particularly, the lens 50"" comprises a planar viewing wall 52"", a first or upper side wall 54"" and a second or lower side wall 56"". First rib 72 and a second rib 58*b*"" project generally inwardly toward each other from the side walls 54"", 56"", respectively. The first rib 72 includes a bend 74. A first portion 76 of rib 72 projects from the side wall 54"" parallel to planar viewing wall 52"". A second portion 78 of rib 72 extends from bend 74 angularly toward planar viewing wall 52"". The side wall 54"" comprises the mounting portion 70 that is connected to the viewing wall 52"" by way of a living hinge 55"" that can be formed as a one-piece construction with the mounting portion 72 and viewing wall 52"". The mounting portion 72 of the lens 50"" is secured to an associated holder in a position so that the viewing wall 52"" is adapted for pivoting movement on an arc C between a closed position (shown in FIG. 2E) wherein the viewing wall 52"" is placed in covering relation with an associated electronic price label secured to a holder, and an open position (not shown) wherein the viewing wall 52"" is moved away from an associated electronic price label allowing access to same. In the closed position, the finger 58*b*"" engages a side wall of a holder so that the lens 50"" is resistant to movement from its closed position to its open position. Those of ordinary skill in the art will recognize that the mounting portion 70, the living hinge 55"", the upper side wall 54"", and the planar viewing wall 52"" cooperate to prevent spilled liquids from contacting an associated electronic price label.

Figure 3A:
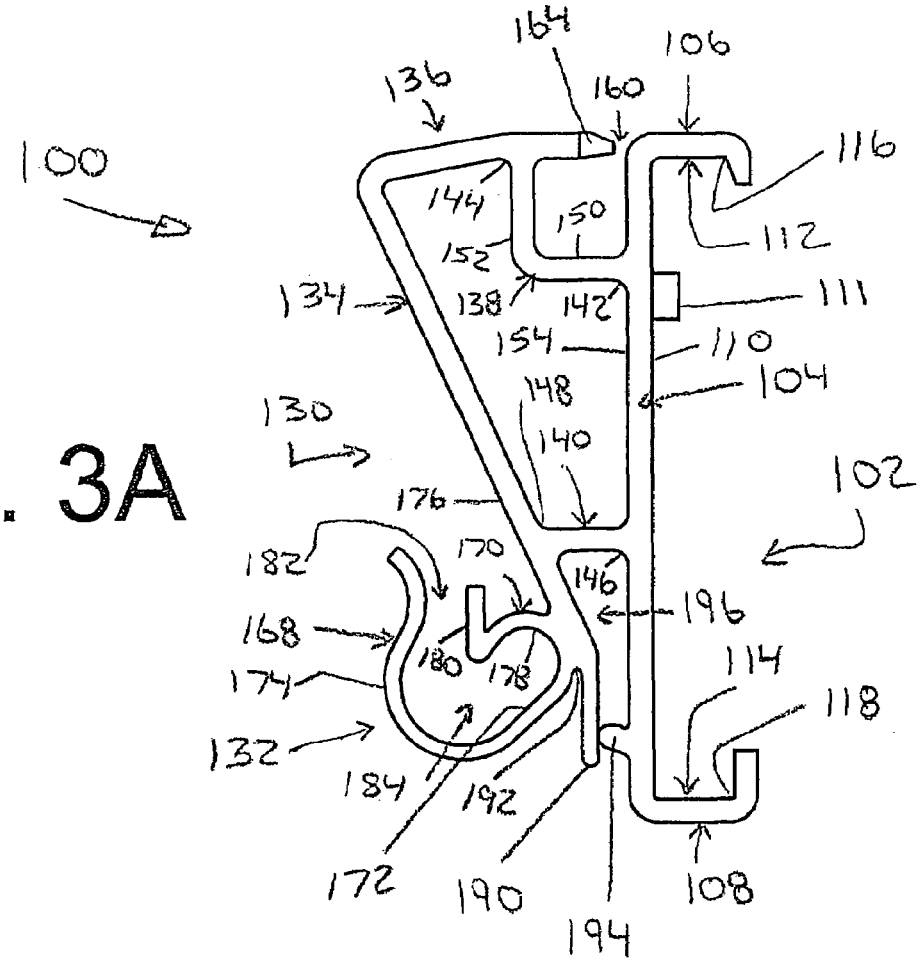
FIG. 3A is a side elevational view of one version of a second type of holder for an EPL formed in accordance with the present invention.

With reference now to FIG. 3A, a holder 100 for an electronic price label or the like is there illustrated. The holder 100 is formed in accordance with the present invention from polyvinyl chloride plastic or any other suitable plastic by extrusion, molding, or any suitable plastic forming technique. The holder 100 includes a base channel or C-channel 102 having an overall C-shaped configuration to slidably accommodate and frictionally retain an associated electronic price label. The C-channel 102 is defined by a base wall 104 which is preferably planar, and top and bottom walls 106, 108, also referred to as first and second side walls, respectively. The top and bottom walls 106, 108 project outwardly from a front face 110 of the base wall 104, preferably a like distance and substantially perpendicular to the base wall 104. Thus, the top and bottom walls 106, 108 are arranged generally parallel to each other to accommodate an associated EPL in the recess defined therebetween and together with the base wall 104. A resilient strip 111 of a suitable conventional thermoplastic material, proximal to top wall 106, projects outwardly from the front face 110 of the base wall 104 to facilitate retention of an associated EPL.

The opposed, inward faces 112, 114 of the top and bottom walls 106, 108, respectively, include grooves 116, 118 which accommodate projections extending outwardly from the associated EPL positioned in the C-channel 102. This construction allows an associated EPL to be inserted and removed from the recess defined in the C-channel 102 by sliding and/or by movement of the EPL in a direction toward and away from the base wall 104.

The holder further comprises a connector 130 secured to the C-channel 102 by way of the base wall 104. The connector 130 is adapted to secure the holder 100 to an associated shelf S shown in FIG. 3B. More particularly, the connector 130 comprises a resilient clip 132, a back wall 134, and a top wall 136.

The connector 130 and the C-channel 102 are interconnected by way of a first arm 138 and a second arm 140. The first arm 138 comprises a first end 142 connected to the base wall 104 and a second end 144 connected to the top portion 136 of the connector 130 so that the first arm 138 is positioned between the back portion 134 of the connector 130 and the C-channel 102. The second arm 140 comprises a first end 146 connected to the base wall 104 of the C-channel 102 and a second end 148 connected to the back portion 134 of the connector 130 so that the second arm 140 is positioned between the back portion 134 of the connector 130 and the C-channel 102. Since the entire holder 100 is made from a suitable conventional plastic material, such a polyvinylchloride or the like, the holder is resilient in nature.

The first connecting arm includes a first segment 150 projecting perpendicularly from a rear face 154 of base wall 104. A second segment 152 of the first connecting arm 138 extends upward toward the top portion 136 of the connector 130 generally parallel with the base wall 104. The second segment 152 connects the first arm 138 to the top portion 136 of the connector 130. In this embodiment, the first and second segments are perpendicular to each other. The second connecting arm 140 extends perpendicular from the rear face 154 of the base wall and connects the rear face 154 of the base wall 104 to the back wall 134 of the connector 130. The top wall 136 of the connector 130 and the rear face 154 of the base wall 104 define an upwardly open slot 160 or channel therebetween. An end 164 of the top portion 136 of the connector 130 can include a tip made of a conventional resilient plastic to facilitate connection and retention of an associated lens (not illustrated) in slot 160.

The clip 132 of the connector 130 comprises an L-shaped resilient member having a first leg 168 and a second leg 170. The first leg 168 includes a first segment 172 projecting rearwardly from a rear side 176 of the back wall 134 of the connector 130. A second segment 174 of the first leg 168 extends upwardly generally toward top wall 106. The second leg 170 of the clip 132 includes a first segment 178 projecting rearwardly from the rear side 176 of the back wall 134 of the connector 130 in the same general direction as the first segment 172 of the first leg 168. A second segment 180 of the second leg 170 extends upwardly toward the top wall 136 of the connector 130. The first leg 168 and the second leg 170 of the clip 132 define an upwardly open slot 182 or channel therebetween. The innermost closed end 184 of the slot 182 is enlarged. The opened end or mouth of the slot 182 is preferably defined between the second segment 174 of the first leg 168 and the second segment 180 of the second leg 170 of the clip 132 of the connector 130 so as to facilitate insertion of a shelf (FIG. 3B) therein for attachment of the holder 100 thereto.

A resilient finger 190 projects from an end 192 of first leg 168 of the clip 132 and extends generally parallel to the base wall 104 in a direction toward the second side wall 108. The finger 190 contacts a nib 194 projecting from the rear face 154 in the region of the second side wall 108 so that a closed slot 196 is defined between the finger 190 and the rear face 154. An advertising flyer or the like (not illustrated) can be selectively secured in the slot 196 by insertion of same between the finger 190 and the nib 194 where it is frictionally or otherwise retained.

As seen in FIG. 3A, the C-channel 102 is not rearwardly inclined relative to vertical when in its operative position. The holder 100, due to its lack of inclination relative to vertical, is particularly adapted for a connection to an associated shelf at a viewer's eye level. Of course, those of ordinary skill in the art will recognize that the C-channel 102 can be arranged at a wide variety of other desired angles relative to the connector 130 so that the C-channel 102 defines other viewing angles relative to vertical without departing from the overall scope and intent of the present invention.

Figure 3B:
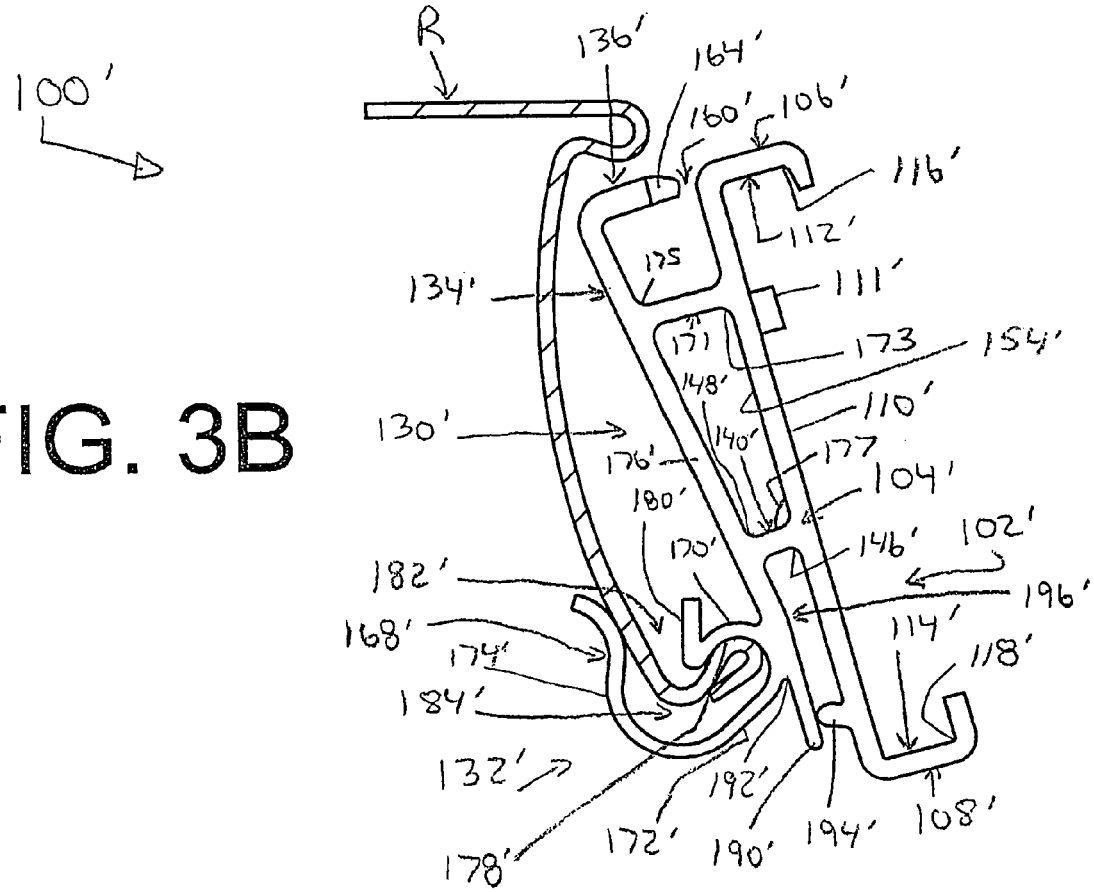
FIG. 3B is a side elevational view of another version of the second type of EPL holder secured to an associated retail shelving in accordance with the present invention.

With reference now to FIG. 3B, another version of a holder for an electronic price label or the like is there illustrated. In this embodiment, like components relative to the holder 100 are identified with like reference numbers including a single primed (') suffix and new components are identified by new numerals.

A holder 100' includes a base channel 102' having an overall C-shaped configuration to slidably accommodate and frictionally retain an associated electronic price label. The C-channel 102' is defined by a base wall 104' which is preferably planar, and top and bottom walls 106', 108'. The top and bottom walls 106', 108' project outwardly from a front face 110' of the base wall 104' and are arranged generally parallel to each other to accommodate an associated EPL in the recess defined therebetween and together with the base wall 104'. The opposed, inward faces 112', 114' of the top and bottom walls 106', 108', respectively, include grooves 116', 118' which accommodate projections extending outwardly from the associated EPL positioned in the C-channel 102'.

The holder 100' further comprises a connector 130' connected to the C-channel 102' by way of the base wall 104'. The connector 130' is adapted to secure the holder 100' to an associated shelf R. More particularly, the connector 130' comprises a clip 132', a back wall 134', and a top wall 136'.

The connector 130' and the C-channel 102' are interconnected by way of a first arm 171 and a second arm 140'. The first arm 171 comprises a first end 173 connected to the base wall 104' and a second end 175 connected to the back wall 134' of the connector 130' so that the first arm 171 is positioned between the back wall 134' and the C-channel 102'. The second arm 144' comprises a first end 146' connected to the base wall 104' of the C-channel and a second end 148' connected to the back wall 134' of the connector 130' so that the second arm 140' is positioned between the back wall 134' and the C-channel 102'.

In this embodiment, both the first connecting arm 171 and the second connecting arm 140' extend perpendicular from the rear face 154' of the base wall 104' and connect the rear face 154' of the base wall 104' to the back wall 134' of the connector 130'. The top wall 136' of the connector 130' and the rear face 154' of the base wall 104' define an upwardly open slot 160' or channel therebetween.

The clip 132' of the connector 130' is identical to the one illustrated in FIG. 3A and, thus, its description will not be repeated here.

A mounting angle 177 is defined between the second arm 140' and the C-channel base wall 104' by the second arm 140' connected between the rear face 154' of the base wall 104' and the back wall 134' of the connector 130' so that the C-channel 102' is rearwardly inclined relative to vertical by a select angle. As seen in FIG. 3B, the C-channel is rearwardly inclined approximately 15 degrees relative to vertical when in its operative position.

The holder 100' due to its inclination relative to vertical, is particularly adapted for a connection to an associated shelf below a viewer's eye level. Of course, those of ordinary skill in the art will recognize that the C-channel 102' can be arranged at any other desired angle relative to the connector 130' so that the C-channel 102' defines other viewing angles relative to vertical without departing from the overall scope and intent of the present invention.

Figure 3C:
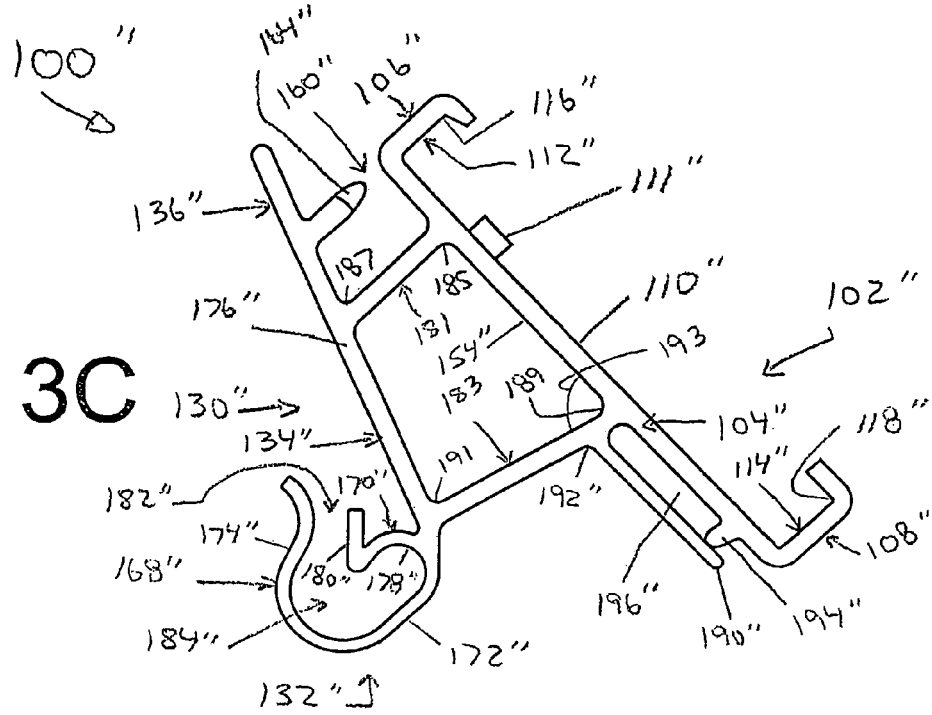
FIG. 3C is a side elevational view of still another version of the second type of holder for an EPL formed in accordance with another embodiment of the present invention.

With reference now to FIG. 3C, another embodiment of a holder for an electronic price label or the like is illustrated. In this embodiment, like components are identified with like reference numbers including a double-primed (") suffix and new components are identified by new numerals.

A holder 100" includes a base channel 102" having an overall C-shaped configuration to slidably accommodate and frictionally retain an associated electronic price label.

The holder 100" further comprises a connector 130" secured to the C-channel 102" by way of the base wall 104". The connector 130" is adapted to secure the holder 100" to an associated shelf (FIG. 3B). More particularly, the connector 130" comprises a resilient clip 132", an upwardly projecting back wall 134", and a top wall 136".

The connector 130" and the C-channel 102" are interconnected by way of a first arm 181 and a second arm 183. The first arm 181 comprises a first end 185 connected to the base wall 104" and a second end 187 connected to the back wall 134" of the connector 130" so that the first arm 181 is positioned between the back wall 134" of the connector 130" and the C-channel 102". The second arm 183 comprises a first end 189 connected to the base wall 104" of the C-channel 102" and a second end 191 connected to the back wall 134" of the connector 130" so that the second arm 183 is positioned between the back wall 134" of the connector 130" and the C-channel 102".

More particularly, the first connecting arm 181 projects perpendicularly from the rear face 154" of base wall 104". The second connecting arm 183 extends nearly perpendicular from the rear face 154" of the base wall 104" and connects it to the back wall 134" of the connector 130". It can be seen that the first connecting arm 181 has a length less than the length of the second connecting arm 183. The top wall 136" of the clip 130" and the rear face 154" of the base wall 104" define an upwardly open slot 160" or channel therebetween. As in the previous embodiments, a clip 132" is provided at a lower end of the back wall 134".

A mounting angle 193 is defined between the second arm 183 and the C-channel base wall 104" so that the C-channel 102" is rearwardly inclined relative to vertical by a select angle. As seen in FIG. 3C, the C-channel is rearwardly inclined approximately 45° relative to vertical when in its operative position.

The holder 100", due to its inclination relative to vertical, is particularly adapted for a connection to an associated shelf well below a viewer's eye level. Of course, those of ordinary skill in the art will recognize that the C-channel 102" can be arranged at a wide variety of other desired angles relative to the clip portion 130" so that the C-channel 102" defines other viewing angles relative to vertical without departing from the overall scope and intent of the present invention.

Figure 4A:
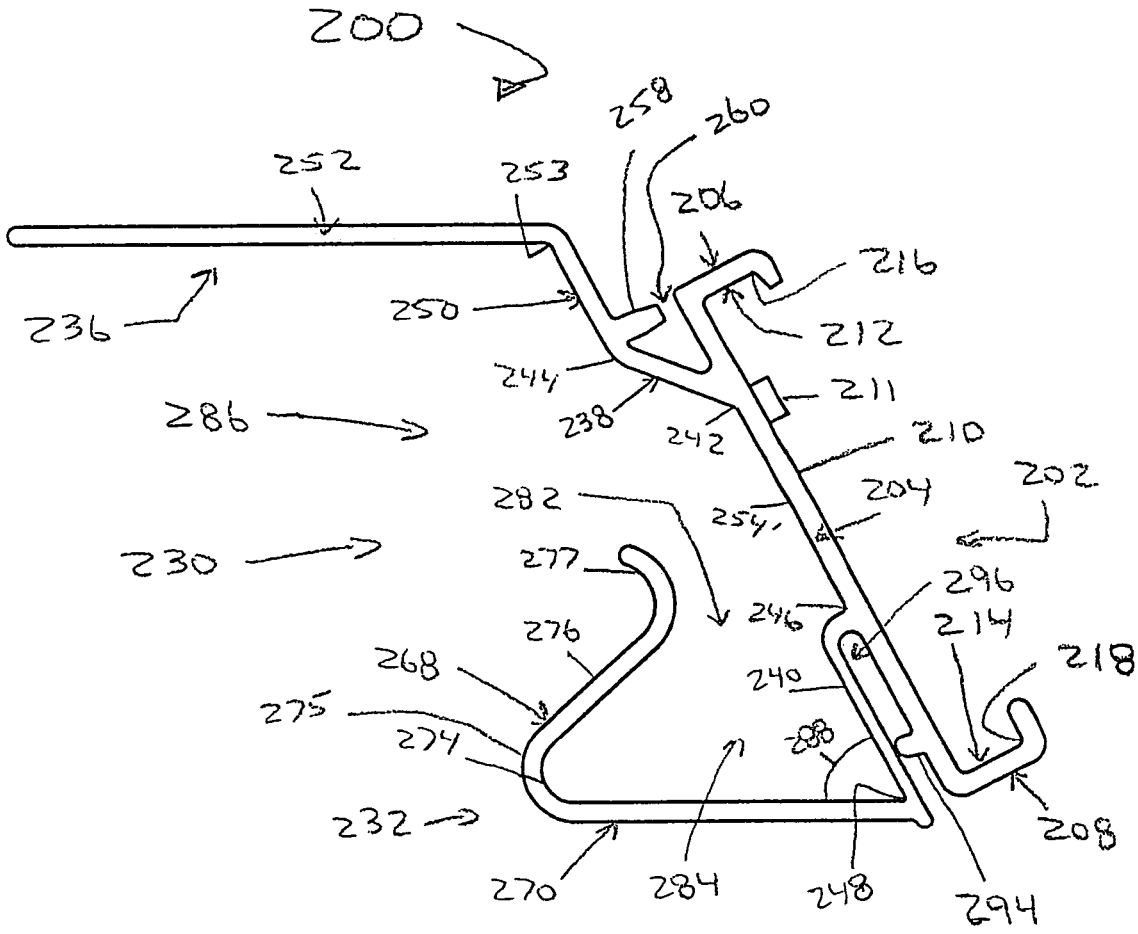
FIG. 4A is a side elevational view of one version of a third type of holder for an EPL formed in accordance with the present invention.

With reference now to FIG. 4A, another embodiment of a holder for an electronic price label or the like is illustrated at 200. The holder 200 is formed in accordance with the present invention from a suitable conventional resilient material, such as polyvinyl chloride plastic or any other suitable plastic by extrusion, molding, or any suitable plastic forming technique. Preferably, the holder 200 is an extrusion having a profile as shown in FIG. 4A. The holder 200 includes a base channel 202 having an overall C-shaped configuration to slidably accommodate and frictionally retain an associated electronic price label. The C-channel 202 is defined by a base wall 204 which is preferably planar, and top and bottom walls 206, 208, also referred to as first and second side walls, respectively. The top and bottom walls 206, 208 project outwardly from a front face 210 of the base wall 204, preferably a like distance and substantially perpendicular to the base wall 204. Thus, the top and bottom walls are 206, 208 arranged generally parallel to each other to accommodate an associated EPL in the recess defined therebetween and together with the base wall 204. A resilient strip 211, located proximal to top wall 206, projects outwardly from the front face 210 of the base wall 204 to facilitate retention of the associated EPL.

The opposed, inward faces 212, 214 of the top and bottom walls 206, 208, respectively, include grooves 216, 218 which accommodate projections extending outwardly from the associated EPL positioned in the C-channel 202. This construction allows an associated EPL to be inserted and removed from the recess defined in the C-channel 202 by sliding and/or by movement of the EPL in a direction toward and away from the base wall 204.

The holder 200 further comprises a mounting portion 230 connected to the C-channel 202 by way of the base wall 204. The mounting portion 230 is adapted to secure the holder 200 to an associated shelf shown in FIG. 4C. More particularly, the mounting portion 230 comprises a clip 232 and a top wall 236.

The top wall 236 and the C-channel 202 are resiliently interconnected by way of a first arm 238. A second arm 240 (also referred to as a resilient finger) connects the clip 232 to the C-channel 202. The first arm 238 comprises a first end 242 connected to the base wall 204 and a second end 244 connected to the top wall 236. The second arm 240 comprises a first end 246 connected to the base wall 204 of the C-channel 202 and a second end 248 connected to the clip 232.

More particularly, the first connecting arm 238 projects upwardly from a rear face 254 of base wall 204. The first connecting arm 238 extends upward toward the top wall 236 of the mount 230 and connects at a second end 244 thereof. The second connecting arm 240 extends from first end 246 parallel to the rear face 254 of the base wall 204 and connects the rear face 254 of the base wall 204 to the clip 232 at its second end 248. It can be seen that the first connecting arm 238 projects outwardly and upwardly from the rear face 254.

The top wall 236 comprises an L-shaped first segment 250 and a second segment 252. L-shaped first segment 250 connects to first connecting arm 238 at end 244. The L-shaped first segment 250 comprises a first leg 256 and a second leg 257. The first leg 256 extends outward from end 244 toward top wall 206. The second leg 257 extends upward generally parallel to base wall 204. The second segment 252 connects to the second leg 257 at bend 253. The second segment 252 extends rearward away from the base wall 204. Therefore, the top portion 236 is also defined with an overall L-shaped configuration. The second segment 252 contains thru slots 255 therein for accommodating fasteners.

The first leg 256 terminates at a tip 258 which can comprise a resilient plastic material. The tip 258 of the L-shaped bend 256 and the rear face 254 of the base wall 204 define an upwardly open slot 260 or channel therebetween. The innermost closed end 262 of the slot 260 is enlarged. The tip 258 of the first leg 256 and the rear face 254 of the base wall 204 define therebetween a restricted portion of the slot 260. The open end or mouth of the slot 260 is preferably defined between the top portion 236 of the mount 230 and the top wall 206 so as to facilitate insertion and removal of a portion of an associated window of the type shown in FIGS. 2A-2E.

The clip 232 of the mount 230 comprises an upper member 268 and a lower member 270. The lower member 270 projects rearwardly generally parallel to second segment 252 from the second end 248 of the second arm 240. The lower member 270 connects to upper member 268 at bend 274. The upper member 268 comprises an S-shaped configuration including a first segment 275 projecting rearwardly and upwardly from the bend 274 of the lower member 270. A second segment 276 of the upper member 268 extends upwardly toward the top portion 236 of the mount portion 230. A third segment 277 of the upper member 268 extends rearwardly away from rear face 254 of the base wall 204. The upper member 268 and the rear face 254 of the base wall 204 define an upwardly open slot 282 or channel therebetween. The innermost closed end 284 of the slot 282 is enlarged. The opened end 286 or mouth of the slot 282 is preferably defined between the first arm 238 and the third segment 277 of the upper member 268 of the base portion 232 of the mount portion 230 so as to facilitate mounting on a shelf (FIG. 4C) therein for attachment of the holder thereto.

A mounting angle 288 is defined between the base portion 232 and the C-channel base wall 204 by the second arm 240 connected between the rear face 254 of the base wall 204 and the lower member 270 of the base portion 232. As seen in FIG. 4A, the C-channel is rearwardly inclined approximately 30° relative to vertical when in its operative position.

The second arm or resilient finger 240 projects from the rear face 254 of the base wall 204 and extends generally parallel to the base wall 204 in a direction toward the bottom wall 208. The finger 240 connects a nib 294 projecting from the rear face 254 in the region of the bottom wall 208 so that a closed slot 296 is defined between the finger 240 and the rear face 254. An advertising flyer or the like (not illustrated) is selectively secured in the slot 296 by insertion of same between the finger 240 and the nib 294 where it is frictionally or otherwise retained.

The holder 200, due to its inclination relative to vertical, is particularly adapted for a connection to an associated shelf lower than a viewer's eye level. Of course, those of ordinary skill in the art will recognize that the C-channel 202 can be arranged at any of a wide variety of other desired angles relative to the clip portion so that the C-channel 202 defines other viewing angles relative to vertical without departing from the overall scope and intent of the present invention.

Figure 4B:
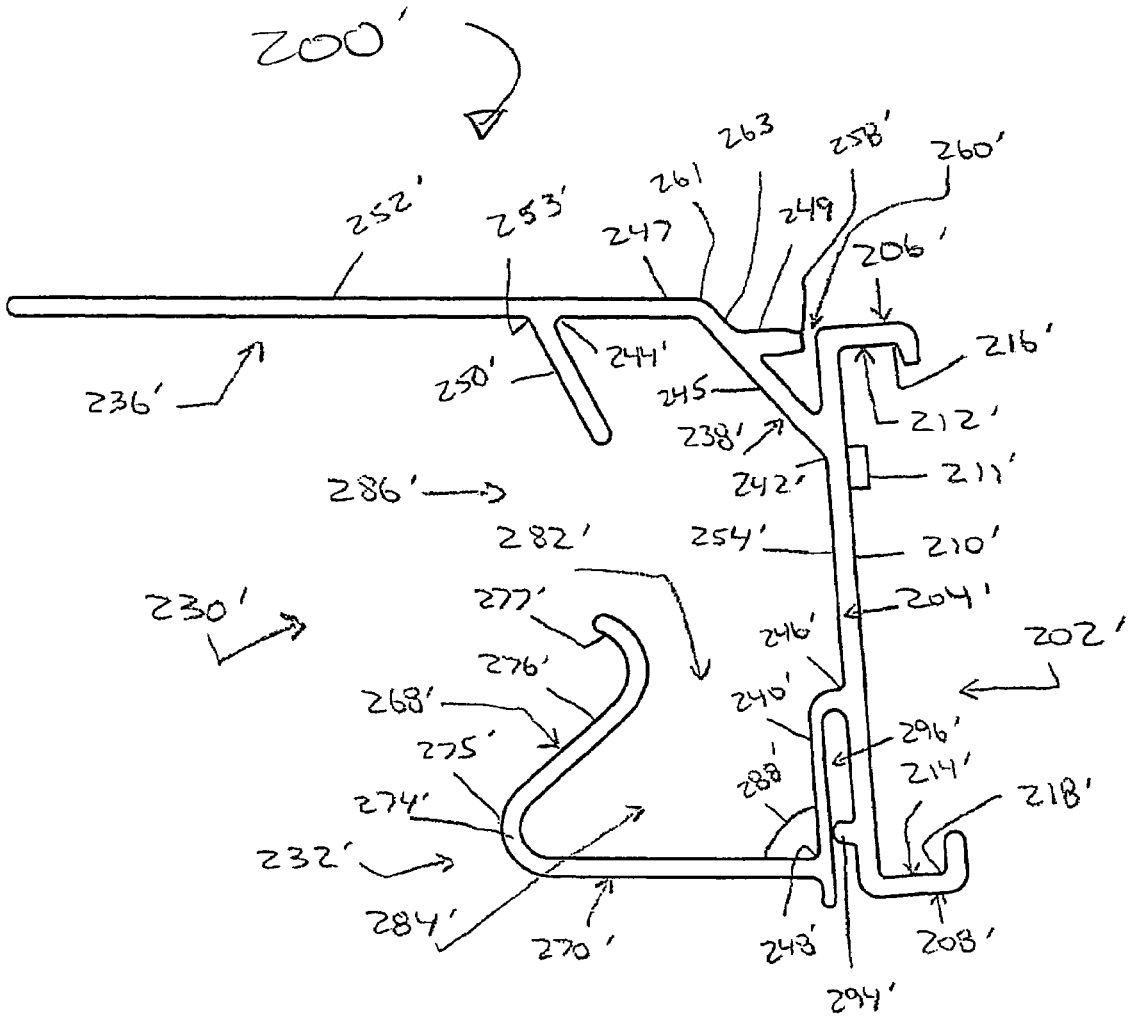
FIG. 4B is a side elevational view of another version of the third type of holder for an EPL formed in accordance with another embodiment of the present invention.

With reference now to FIG. 4B, another embodiment of a holder for an electronic price label or the like is there illustrated. In this embodiment, like components are illustrated by like numerals with a primed suffix (') and new components are illustrated by new numerals. The holder 200' includes a base channel 202' having an overall C-shaped configuration to slidably accommodate and frictionally retain an associated electronic price label.

Figure 4C:
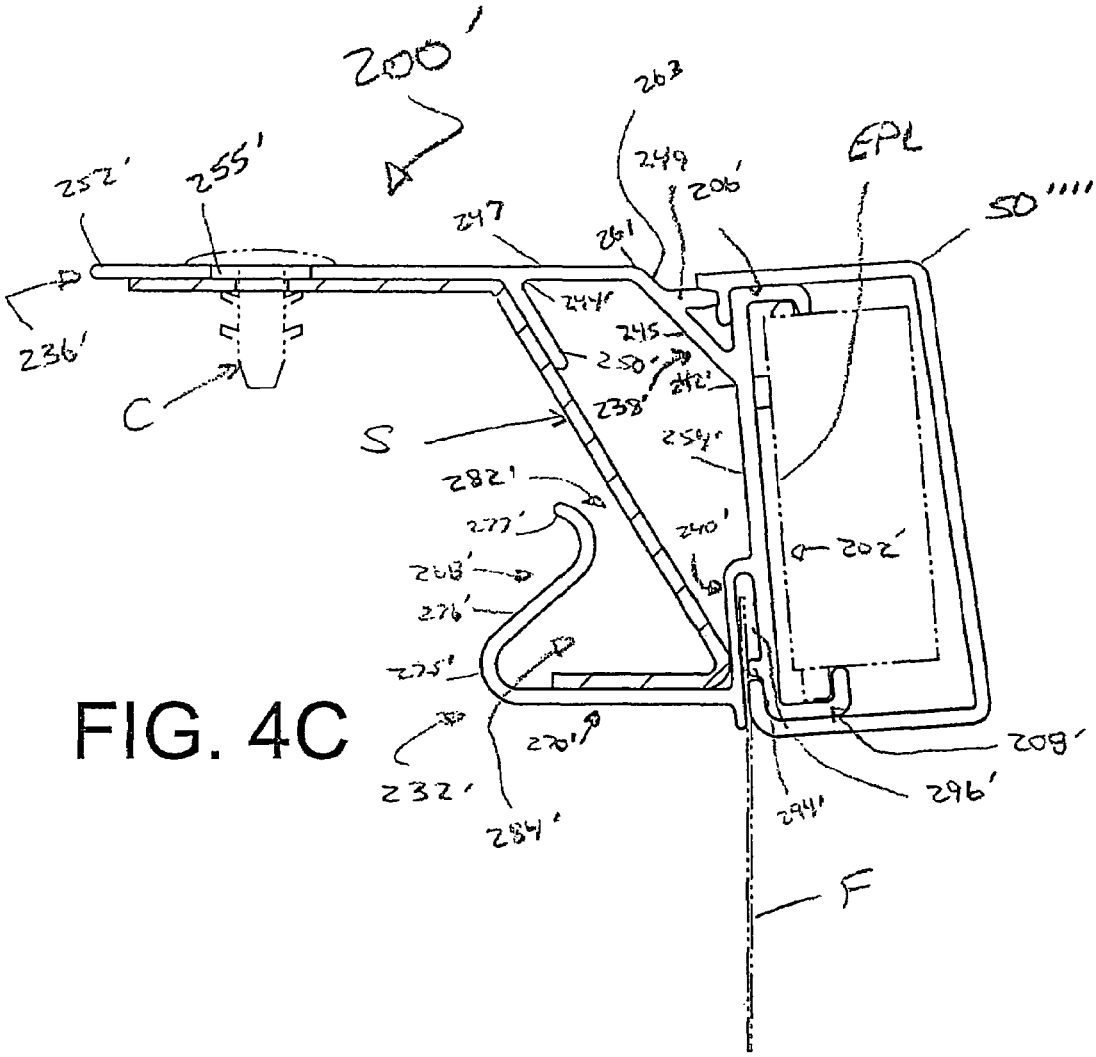
FIG. 4C is a side elevational view of the holder of FIG. 4B secured to a shelf including an associated protective viewing lens placed in covering relation with an EPL.

The holder 200' further comprises a mounting portion 230' connected to the C-channel 202' by way of the base wall 204'. The mounting portion 230' is adapted to secure the holder 200' to an associated shelf(FIG. 4C). More particularly, the shelf attachment mount portion 230' comprises a resilient member having a base portion 232' and a top portion 236'.

The first connecting arm 238' comprises a first leg 245, a second leg 247, and a third leg 249. More particularly, the first leg 245 projects upwardly and outwardly from the rear face 254' of base wall 204'. The first leg 245 extends upward toward the top portion 236' of the mount 230' and connects to second leg 247 at a bend 261'. The second leg 247' extends from bend 261' to the second end 244'. It can be seen that the first leg 245 and the second leg 247 form an L-shape. The third leg 249 projects from a front wall 263 of first leg 245 toward the top wall 206'. The third leg 249 terminates at a tip 258' which comprises a resilient plastic. The tip 258' of the third leg 249 and the rear face 254' of the base wall 204' define an upwardly open slot 260' or channel therebetween.

The tip 258' of the third leg 249 and the rear face 254' of the base wall 204' define therebetween a restricted portion of the slot 260'. The open end or mouth of the slot 260' is preferably defined between the top portion 236' of the mount 230' and the top wall 206' so as to facilitate insertion and removal of an associated lens. (Not illustrated).

The top portion 236' comprises a first segment 250' and a second segment 252'. First segment 250' connects to first connecting arm 238' at end 244'. The first segment 250' extends downward from end 244' generally parallel to first leg 245. The second segment 252' connects to the first segment 250' at bend 253'. The second segment 252' extends rearward away from the base wall 204'. The second segment 252' contains thru slots 255' therein.

A mounting angle 288' is defined between the base portion 232' and the C-channel base wall 204' by the second arm 240' connected between the rear face 254' of the base wall 204' and the lower member 270' of the base portion 232'. As seen in FIG. 4B, the C-channel is rearwardly inclined approximately 50 relative to vertical when in its operative position.

The second arm or resilient finger 240' projects from the rear face 254' of the base wall 204' and extends generally parallel to the base wall 204' in a direction toward the bottom wall 208'. The finger 240' connects a nib 294' projecting from the rear face 254' in the region of the bottom wall 208' so that a closed 296' slot is defined between the finger 240' and the rear face 254'.

The holder 200', due to its small inclination relative to vertical, is particularly adapted for a connection to an associated shelf at about viewer's eye level. Of course, those of ordinary skill in the art will recognize that the C-channel 202' can be arranged at a wide variety of other desired angles relative to the clip portion so that the C-channel 202' defines other viewing angles relative to vertical without departing from the overall scope and intent of the present invention.

With reference now to FIG. 4C, the holder 200' is shown in its operative position clipped (i.e. Christmas tree clip C) to shelf S. The holder is shown with an EPL mounted in the C-channel 202'. The EPL is protected by the viewing lens 50"". An advertising flyer F or the like is selectively secured in the slot 296' by insertion of same between the finger 240' and the nib 294' where it is frictionally or otherwise retained.

Figure 4D:
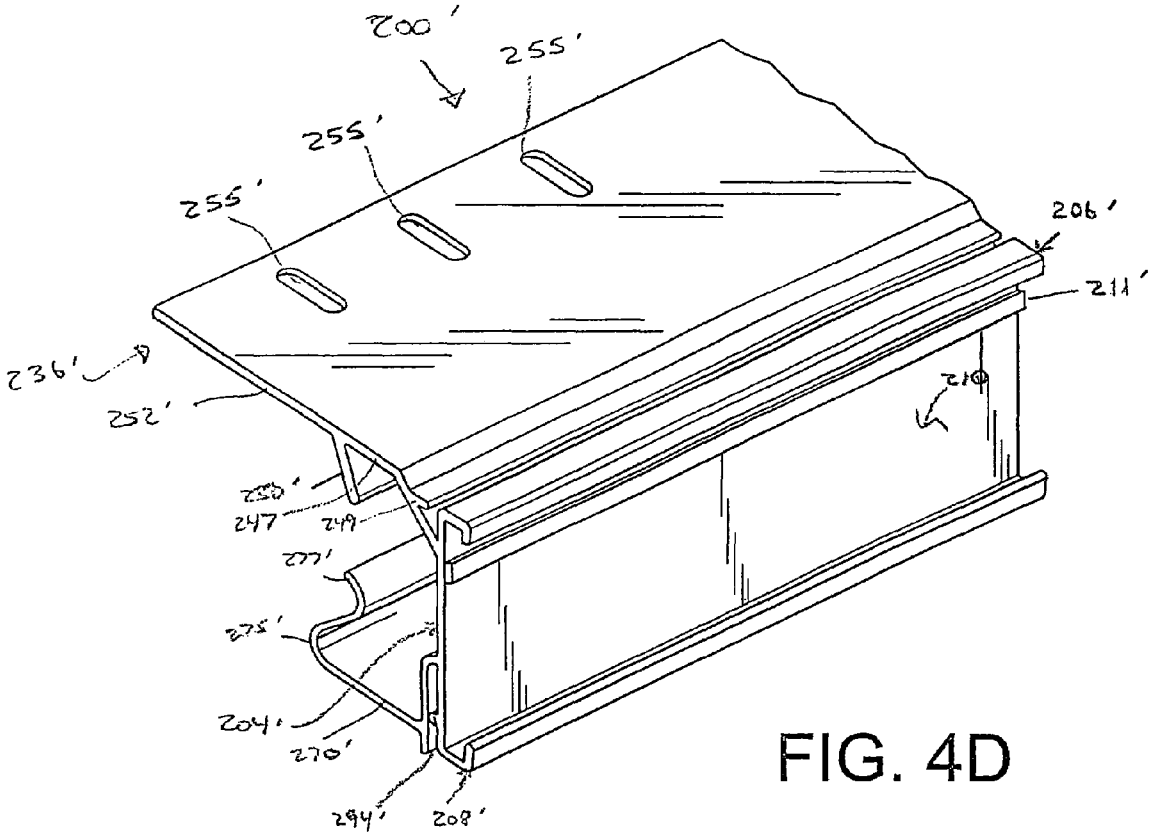
FIG. 4D is a perspective view of the holder of FIG. 4B.

With reference now to FIG. 4D, the holder 200' is shown in perspective view. It can be seen that the second segment 252' of the top wall 236' contains a plurality of through slots 255' for positioning and mounting to shelf S.

Figure 5A:
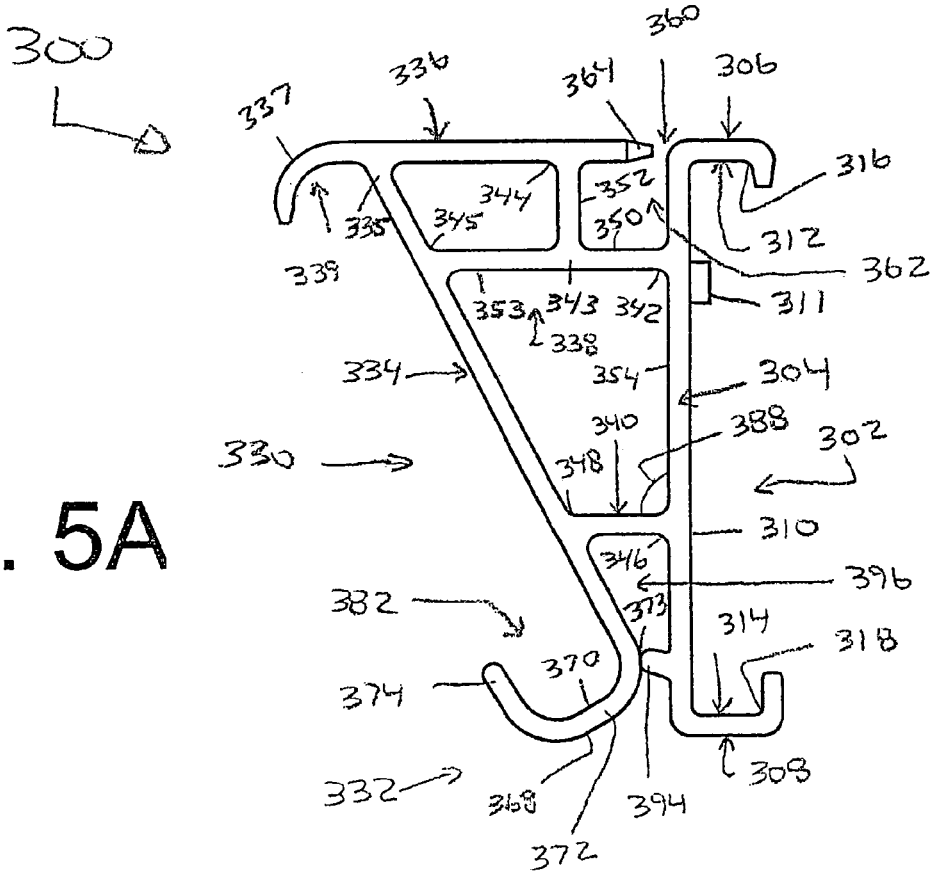
FIG. 5A is a side elevational view of a first version of a fourth type of holder for an EPL formed in accordance with the present invention.

With reference now to FIG. 5A, a further embodiment of a holder 300 for an electronic price label or the like is formed in accordance with the present invention from a suitable conventional thermoplastic, such as polyvinyl chloride plastic or any other suitable plastic by extrusion, molding, or any suitable plastic forming technique. Preferably, the holder 300 is an extrusion having a profile as shown in FIG. 5A. The holder 300 includes a base channel or C-channel 302 having an overall C-shaped configuration to slidably accommodate and frictionally retain an associated electronic price label. The C-channel 302 is defined by a base wall 304 which is preferably planar, and top and bottom walls 306, 308, also referred to as first and second side walls, respectively. The top and bottom walls 306, 308 project outwardly from a front face 310 of the base wall 304, preferably a like distance and substantially perpendicular to the base wall 304. Thus, the top and bottom walls 306, 308 are arranged generally parallel to each other to accommodate an associated EPL in the recess defined therebetween and together with the base wall 304. A strip 311 made from a resilient material extends proximal to top wall 306. It projects outwardly from the front face 310 of the base wall 304 to facilitate retention of an associated EPL.

The opposed, inward faces 312, 314 of the top and bottom walls 306, 308, respectively, include grooves 316, 318 which accommodate projections extending outwardly from the associated EPL positioned in the C-channel 302. This construction allows an associated EPL to be inserted and removed from the recess defined in the C-channel 302 by sliding and/or by movement of the EPL in a direction toward and away from the base wall 304.

The holder 300 further comprises a clip portion 330 connected to the C-channel 302 by way of the base wall 304. The clip portion 330 is adapted to secure the holder 300 to an associated shelf (see FIG. 5B). More particularly, the shelf attachment clip portion 330 comprises a somewhat C-shaped resilient member or body having a bottom wall 332, an upwardly projecting back wall 334, and a top wall 336.

The clip 330 and the C-channel 302 are resiliently interconnected by way of a first arm 338 and a second arm 340. The first arm 338 is T-shaped and comprises a first end 342 connected to the base wall 304, a second end 344 connected to the top wall 336 and a third end 345 connected to the back wall 334 so that the first arm 338 is positioned between the back wall 334 and top wall 336 of the clip 330 and the C-channel 302. The second arm 340 comprises a first end 346 connected to the base wall 304 of the C-channel 302 and a second end 348 connected to the back wall 334 of the clip 330 so that the second arm 340 is positioned between the back wall 334 of the clip 330 and the C-channel 302.

More particularly, the first connecting arm 338 includes a first segment 350 projecting perpendicularly from the rear face 354 of base wall 304 to a connection 343. A second segment 352 of the first connecting arm 338 extends upward from connection 343 toward the top wall 336 of the clip 330 generally parallel with the base wall 304. The second segment 352 connects the first arm 338 to the top wall 336 of the clip 330. A third segment 353 of the first connecting arm 338 extends rearward from the connection 343 linearly with first segment 350 to back wall 334. The third segment 353 connects the first arm 338 to the back wall 334 of the clip 330. It can be seen that the first connecting arm 338 is thus formed with an inverted T-shape. The second connecting arm 340 extends perpendicular from the rear face 354 of the base wall 304 and connects the rear face 354 of the base wall 304 to the back portion 334 of the clip 330. The top wall 336 of the clip 330 and the rear face 354 of the base wall 304 define an upwardly open slot 360 or channel therebetween. The innermost closed end 362 of the slot 360 is enlarged. An end 364 of the top wall 336 of the clip 330 can include a layer of a resilient plastic material to facilitate connection and retention of an associated lens (of the type illustrated in FIGS. 2A-2E) in slot 360.

Additionally, the top wall 336 connects to the back wall 334 at point 335. The top wall 336 includes a segment 337 which projects outwardly and downwardly from point 335. The segment 337 and the back wall 334 of the clip 330 define a downwardly open slot 339 or channel therebetween so as to facilitate insertion of a shelf (FIG. 5B) therein for attachment of the holder 300 thereto. Therefore, the segment 337 defines an overall J-shaped configuration.

The bottom wall 332 of the clip 330 comprises a U-shaped resilient member having an outside face 368 and an inside face 370. The bottom wall 332 includes a first segment 372 projecting rearwardly from a point 373 of back wall 334. A second segment 374 of the bottom wall 332 extends upwardly generally parallel to the back wall 334. The first segment 372 and the second segment 374 of the U-shaped bottom wall 332 define an upwardly open slot 382 or channel therebetween. The opened end or mouth of the slot 382 is preferably defined between the second segment 374 of the bottom wall 332 and the back wall 334 so as to facilitate insertion of a shelf (see FIG. 5B) therein for attachment of the holder 300 thereto. Therefore, the first segment 372 and the second segment 374 define an overall U-shaped configuration therebetween.

A mounting angle 388 is defined between the clip back portion 334 and the C-channel base wall 304 by the second arm 340 connected between the rear face 354 of the base wall 304 and the back wall 334 of the clip so that the C-channel 302 is rearwardly inclined relative to vertical by a select angle. As seen in FIG. 5A, the C-channel is not rearwardly inclined relative to vertical when in its operative position.

The first segment 372 of bottom wall 332 projects from of the back wall 334 of the clip 330. The first segment 372 contacts a nib 394 projecting from the rear face 354 in the region of the second side wall 308 so that a closed slot 396 is defined between the back portion 334 and the rear face 354. An advertising flyer or the like (not illustrated) is selectively secured in the slot 396 by insertion of same between the first segment 372 and the nib 394 where it is frictionally or otherwise retained.

The holder 300, due to its lack of inclination relative to vertical, is particularly adapted for a connection to an associated shelf at a viewer's eye level. Of course, those of ordinary skill in the art will recognize that the C-channel 302 can be arranged at a wide variety of other desired angles relative to the clip portion 330 so that the C-channel 302 defines other viewing angles relative to vertical without departing from the overall scope and intent of the present invention.

Figure 5B:
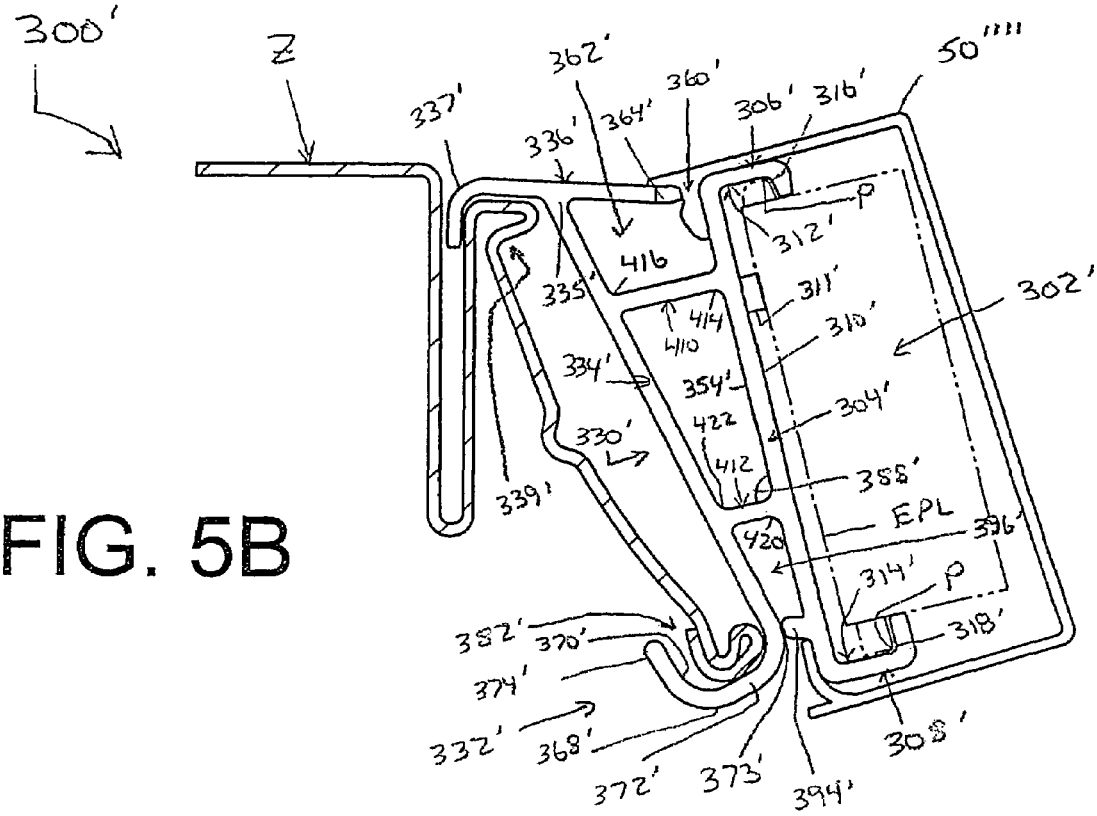
FIG. 5B is a side elevational view of a second version of the fourth type of EPL holder secured to a shelf and including an associated protective viewing lens placed in covering relation with an EPL.

With reference now to FIG. 5B, another holder for an electronic price label or the like is there illustrated. In this embodiment, like components are identified by like numerals with a primed suffix (') and new components are identified by new numerals. A holder 300' includes a base channel 302' having an overall C-shaped configuration to slidably accommodate and frictionally retain an associated electronic price label. The C-channel 302' is defined by a base wall 304' which is preferably planar, and top and bottom walls 306', 308'.

The holder 300' further comprises a clip portion 330' connected to the C-channel 302' by way of the base wall 304'. The clip portion 330' is adapted to secure the holder 300' to an associated shelf Z. More particularly, the shelf attachment clip portion 330' comprises an inverted C-shaped resilient member having a bottom wall 332', an upwardly projecting back wall 334', and a top wall 336'.

The clip 330' and the C-channel 302' are resiliently interconnected by way of a first arm 410 and a second arm 412. The first arm 410 comprises a first end 414 connected to the base wall 304' and a second end 416 connected to the back wall 334' of the clip 330' so that the first arm 410 is positioned between the back wall 334' of the clip 330' and the C-channel 302'. The second arm 412 comprises a first end 420 connected to the base wall 304' of the C-channel 302' and a second end 422 connected to the back wall 334' of the clip 330' so that the second arm 412 is positioned between the back wall 334' of the clip 330' and the C-channel 302'.

More particularly, the first connecting arm 410 projects perpendicularly from a rear face 354' of base wall 304'. The second connecting arm 412 extends perpendicular from the rear face 354' of the base wall 304' and connects the rear face 354' of the base wall 304' to the back wall 334' of the clip 330'. The top wall 336' of the clip 330' and the rear face 354' of the base wall 304' define an upwardly open slot 360' or channel therebetween. The innermost closed end 362' of the slot 360' is enlarged. An end 364' of the top portion 336' of the clip 330' can be made of a resilient plastic material to facilitate connection and retention of an associated lens (i.e. 50"") in slot 360'.

The holder 300', due to its inclination relative to vertical, is particularly adapted for a connection to an associated shelf below a viewer's eye level. Of course, those of ordinary skill in the art will recognize that the C-channel 302' can be arranged at any other desired angle relative to the clip portion 330' so that the C-channel 302' defines other viewing angles relative to vertical without departing from the overall scope and intent of the present invention.

Figure 5C:
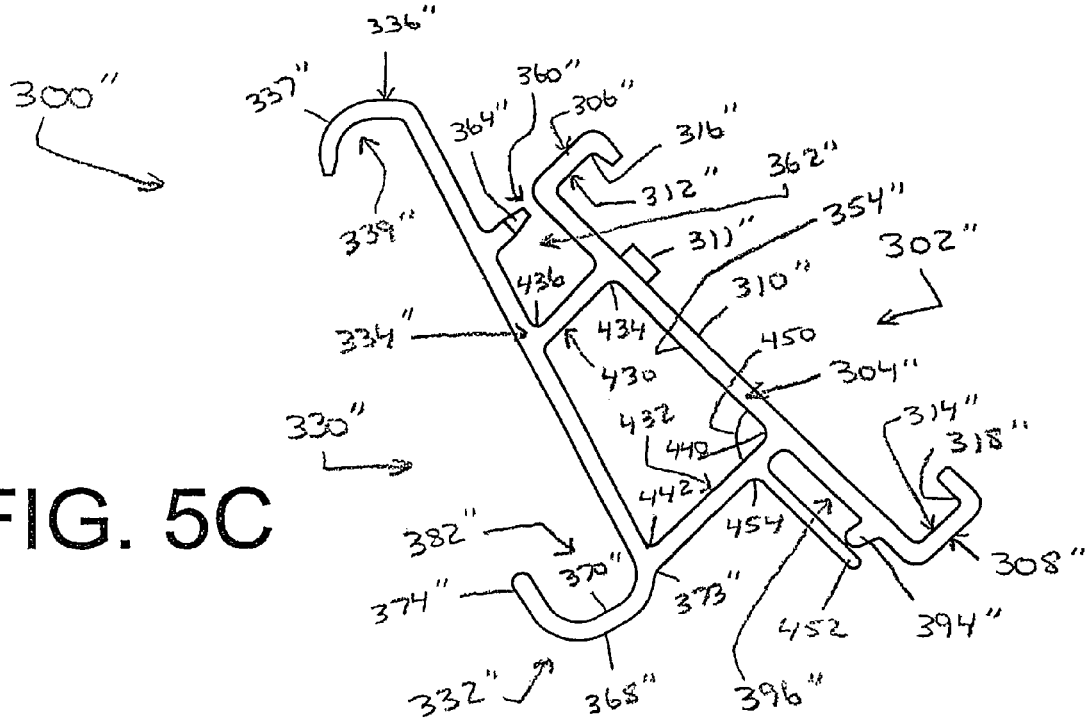
FIG. 5C is a side elevational view of a third version of the fourth type of holder formed in accordance with another embodiment of the present invention.

With reference now to FIG. 5C, another holder for an electronic price label or the like is illustrated. For ease of comprehension, like components are identified by like components with a double-primed suffix (") and new components are identified by new numerals. A holder 300" includes a base channel 302" having an overall C-shaped configuration to slidably accommodate and frictionally retain an associated electronic price label. The C-channel 302" is defined by a base wall 304" which is preferably planar, and top and bottom walls 306", 308".

The holder 300" further comprises a clip portion 330" connected to the C-channel 302" by way of the base wall 304". The clip portion 330" is adapted to secure the holder 300" to an associated shelf (see FIG. 5B). More particularly, the shelf attachment clip portion 330" comprises a resilient member having a bottom wall 332", an upwardly projecting back wall 334", and a top wall 336".

The clip 330" and the C-channel 302" are resiliently interconnected by way of a first arm 430 and a second arm 432. The first arm 430 comprises a first end 434 connected to the base wall 304" and a second end 436 connected to the back wall 334" of the clip 330" so that the first arm 430 is positioned between the back wall 334" of the clip 330" and the C-channel 302". The second arm 432 comprises a first end 440 connected to the base wall 304" of the C-channel 302" and a second end 442 connected to the back wall 334" of the clip 330" so that the second arm 432 is positioned between the back wall 334" of the clip 330" and the C-channel 302".

More particularly, the first connecting arm 430 projects perpendicularly from the rear face 354" of base wall 304". The second connecting arm 432 extends perpendicular from the rear face 354" of the base wall 304" and connects the rear face 354" of the base wall 304" to the back wall 334" of the clip 330". It can be seen that the first connecting arm 430 has a length less than the length of the second connecting arm 432. The top portion 336" of the clip 330" and the rear face 354" of the base wall 304" define an upwardly open slot 360" or channel therebetween. The innermost closed end 362" of the slot 360" is enlarged.

A mounting angle 450 is defined between the clip back wall 334" and the C-channel base wall 304" by the second arm 432 connected between the rear face 354" of the base wall 304" and the back wall 334" of the clip so that the C-channel 302" is rearwardly inclined relative to vertical by a select angle. As seen in FIG. 5C, the C-channel is rearwardly inclined approximately 45° relative to vertical when in its operative position.

A resilient finger 452 projects from an end 454 of second arm 432 and extends generally parallel to the base wall 304" in a direction toward the second side wall 308". The finger 452 contacts a nib 394" projecting from the rear face 354' in the region of the second side wall 308' so that a closed slot 396' is defined between the back wall 334' and the rear face 354'. An advertising flyer or the like (not illustrated) is selectively secured in the slot 396' by insertion of same between the first segment 372' and the nib 394" where it is frictionally or otherwise retained.

The holder 300", due to its inclination relative to vertical, is particularly adapted for a connection to an associated shelf well below a viewer's eye level. Of course, those of ordinary skill in the art will recognize that the C-channel 302" can be arranged at any other desired angle relative to the clip portion 330" so that the C-channel 302" defines other viewing angles relative to vertical without departing from the overall scope and intent of the present invention.

Figure 6A:
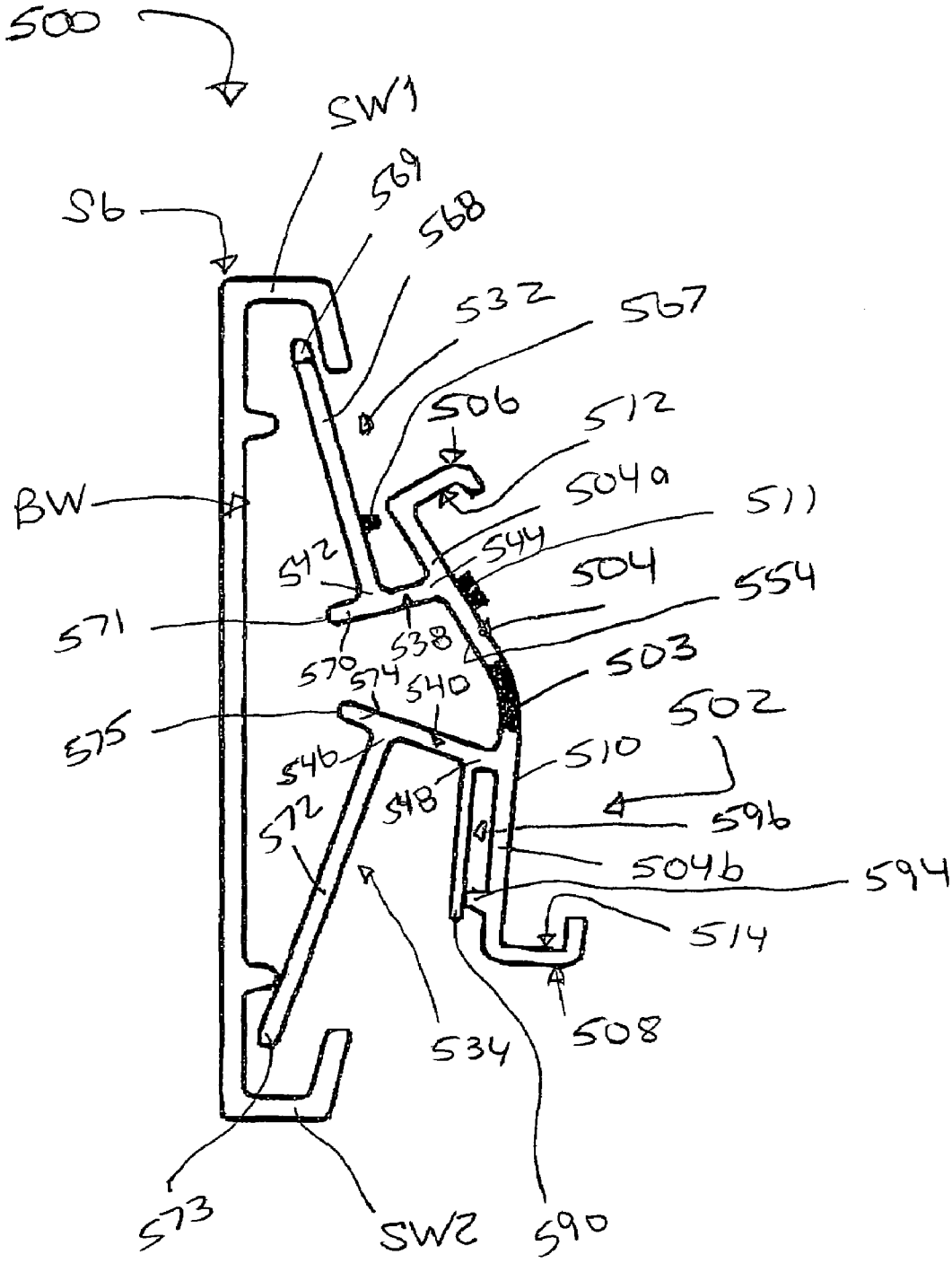
FIG. 6A is a side elevational view of a first version of a fifth type of holder for an EPL formed in accordance with another embodiment of the present invention.
Figure 6B:
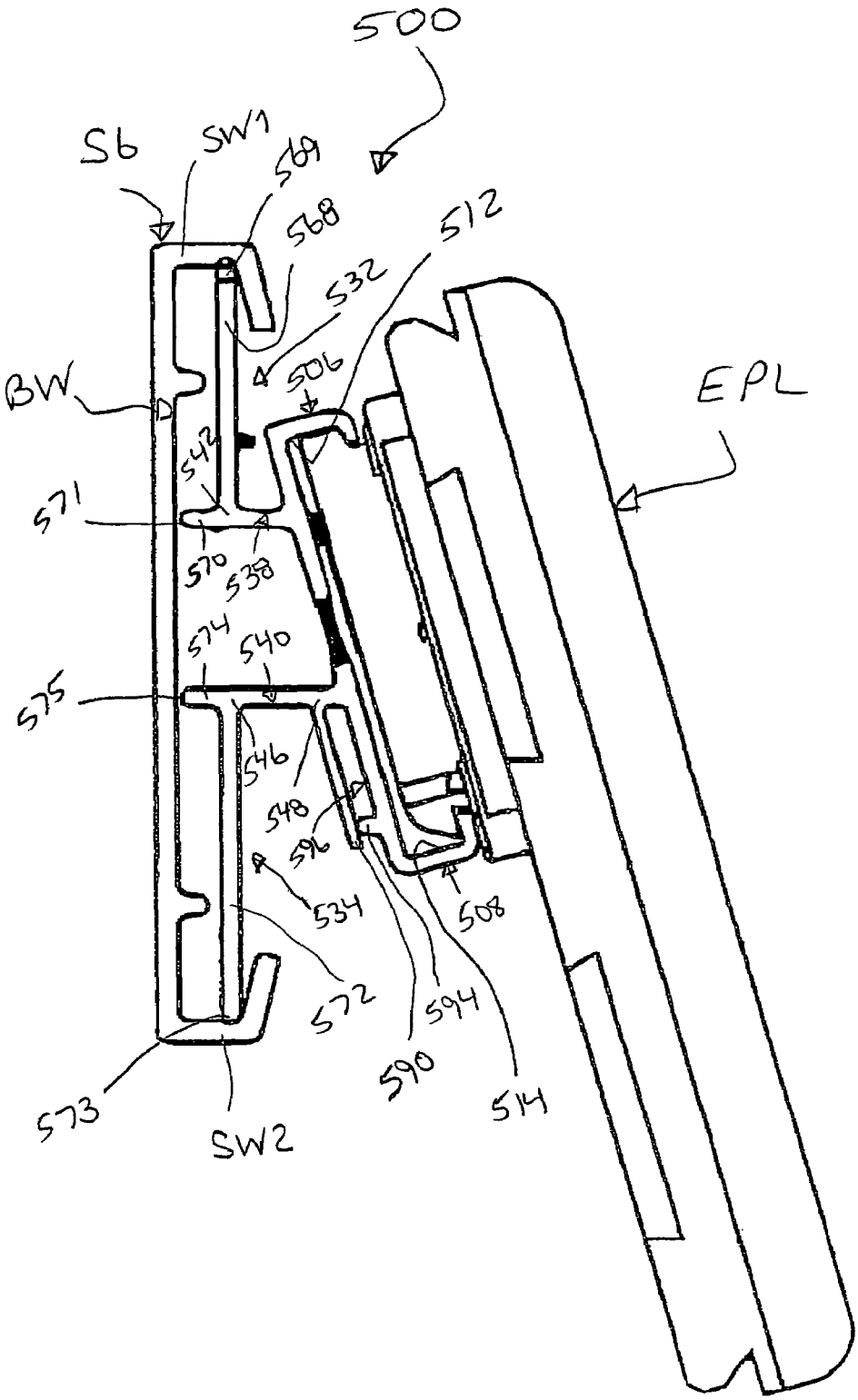
FIG. 6B is a side elevational view of the holder of FIG. 6A as used to secure an associated EPL in an operative position.

With reference now to FIGS. 6A and 6B, another holder 500 for an electronic price label or the like is there illustrated. The holder 500 includes a base channel or C-channel 502 having an overall C-shaped configuration to slidably accommodate and frictionally retain an associated electronic price label. The C-channel 502 is defined by a base wall 504 having a hinge 503, and top and bottom walls 506, 508, also referred to as first and second side walls, respectively. The hinge 503 is located in the base wall 504 and defines a first portion **504*a* and a second portion 504*b* of the base wall 504. The base wall 504 can hinge from a convex or first position (FIG. 6A) to a planar or second position (FIG. 6B). The top and bottom walls 506, 508 project outwardly from a front face 510 of the base wall 504, preferably a like distance and substantially perpendicular to the base wall 504. The top and bottom walls 506, 508 include inward faces 512, 514 arranged in opposed facing relation with each other in the second position. Thus, the top and bottom walls 506, 508 are arranged generally parallel to each other to accommodate an associated EPL, in the second position, in the recess defined therebetween and together with the base wall 504. A resilient strip 511 of a suitable conventional thermoplastic material, proximal to top wall 506, projects outwardly from the front face 510 of the base wall 504** to facilitate retention of an associated EPL.

The holder further comprises top and bottom retainers 532, 534 secured to the C-channel 502 by way of the base wall 504. The retainers 532, 534 are adapted to secure the holder 500 to an associated shelf S6 shown in FIGS. 6A and 6B, or to a holder which is mounted to a shelf.

The top and bottom retainers 532, 534 and the C-channel 502 are interconnected by way of a first or top arm 538 and a second or bottom arm 540. The first arm 538 comprises a first end 542 connected to the top retainer 532 and a second end 544 connected to the base wall 504. The second arm 540 comprises a first end 546 connected to the bottom retainer 534 and a second end 548 connected to the base wall 504 of the C-channel 502. The first and second arms 538, 540 extend rearward and are angled toward one another in the first position. The first and second arms 538, 540 extend rearward and are generally parallel to one another in the second position. In one embodiment, the second arm 540 has a length greater than the first arm 538.

The top retainer 532 comprises a somewhat L-shaped resilient member having an upwardly extending top leg 568 and a rearwardly extending foot member 570. An end 569 of the top leg 568 can include a tip made of a conventional resilient plastic to facilitate connection and retention in a first side wall SW1 of an associated retail shelf S6. A rear face 554 of the channel 502 contacts a nib 567 projecting from the top leg 572 in the region of the top wall 506 so that a stop is defined thereby limiting rearward inclination of channel 502. The bottom retainer 534 comprises a somewhat L-shaped resilient member having a downwardly extending bottom leg 572 and a rearwardly extending foot member 574. An end 573 of the bottom leg 572 can include a tip made of a conventional resilient plastic to facilitate connection and retention in a second side wall SW2 of an associated retail shelf S6. The foot members 570, 574 include tip ends 571, 575 to engage the back wall BW of the associated retail shelf S6 thereby restricting further rotation to the base wall 504 after mounting the holder 500 in the shelf S6 (FIG. 6B).

A resilient finger 590 projects from the second end 548 of the second arm 540 and extends generally parallel to the base wall 504 in a direction toward the second side wall 508. The finger 590 contacts a nib 594 projecting from the rear face 554 in the region of the second side wall 508 so that a closed slot 596 is defined between the finger 590 and the rear face 554. An advertising flyer or the like (not illustrated) can be selectively secured in the slot 596 by insertion of same between the finger 590 and the nib 594 where it is frictionally or otherwise retained.

The holder 500, due to its inclination relative to vertical (FIG. 6B), is particularly adapted for a connection to an associated shelf below a viewer's eye level. Of course, those of ordinary skill in the art will recognize that the C-channel 502 can be arranged at a wide variety of other desired angles relative to vertical so that the C-channel 502 defines other viewing angles relative to vertical without departing from the overall scope and intent of the present invention.

Figure 7:
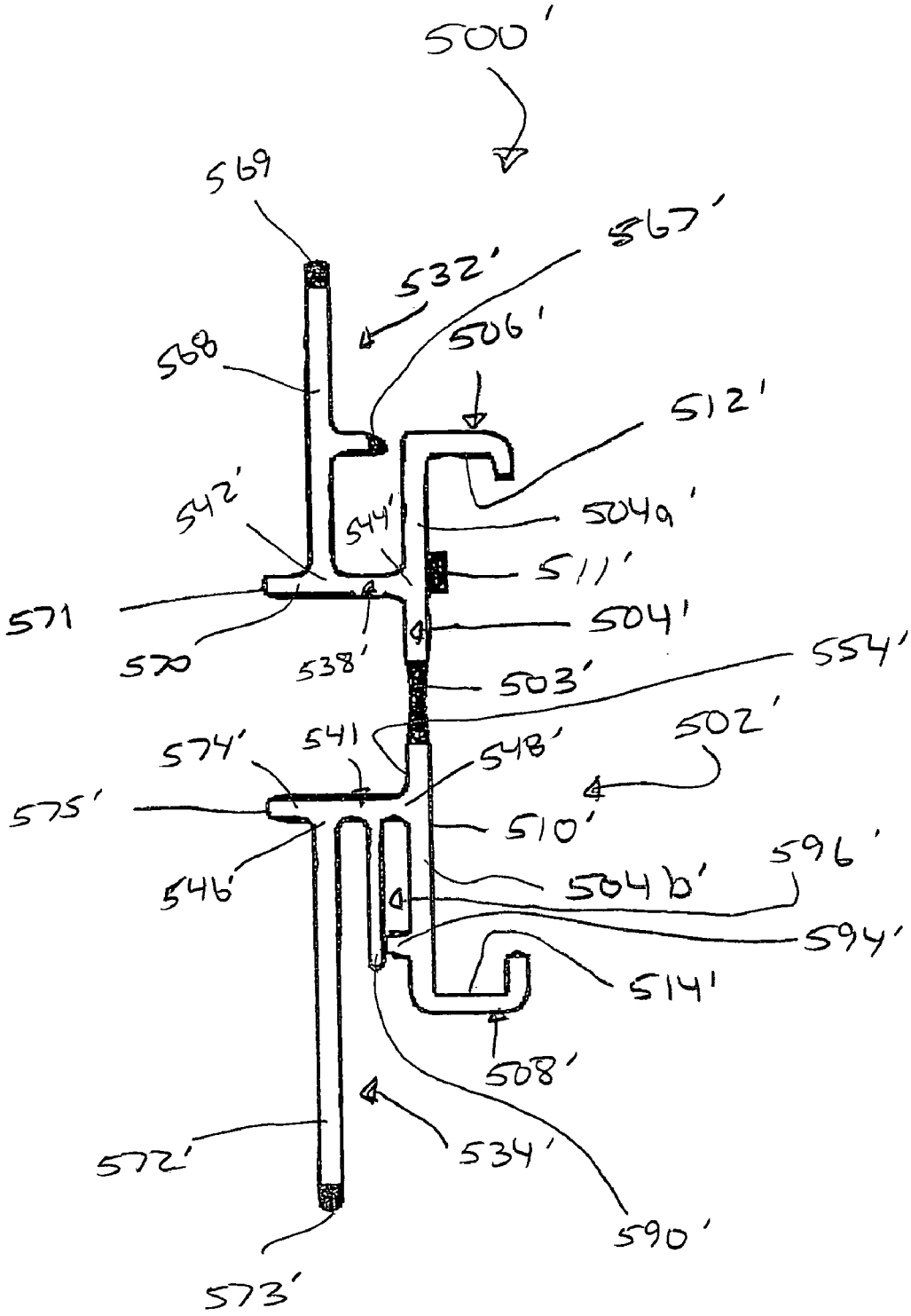
FIG. 7 is a side elevational view of a second version of the fifth type of EPL holder.

With reference now to FIG. 7, another version of a holder for an electronic price label or the like is illustrated. In this embodiment, like components are identified with like reference numbers including a single-primed (') suffix and new components are identified by new numerals.

A holder 500' includes a base channel 502' having an overall C-shaped configuration to slidably accommodate and frictionally retain an associated electronic price label.

The C-channel 502' is defined by a base wall 504' having a hinge 503', and top and bottom walls 506', 508', also referred to as first and second side walls, respectively. The hinge 503' is located in the base wall 504' and defines a first portion 504*a*' and a second portion 504*b*' of the base wall 504'. The base wall 504' hinges from a convex (or first position) to a planar (or second position). The top and bottom walls 506',508' project outwardly from a front face 510' of the base wall 504', preferably a like distance and substantially perpendicular to the base wall 504'. The top and bottom walls 506', 508' include inward faces 512', 514' arranged in opposed facing relation wither each other is the second position. Thus, the top and bottom walls 506', 508' are arranged generally parallel to each other to accommodate an associated EPL, in the second position, in the recess defined therebetween and together with the base wall 504'. A resilient strip 511' of a suitable conventional thermoplastic material, proximal to top wall 506', projects outwardly from the front face 510' of the base wall 504' to facilitate retention of an associated EPL.

The holder further comprises top and bottom retainers 532', 534' secured to the C-channel 502' by way of the base wall 504'. The retainers 532', 534' are adapted to secure the holder 500' to an associated shelf S6 shown in FIGS. 6A and 6B.

The top and bottom retainers 532', 534' and the C-channel 502' are interconnected by way of a first or top arm 538' and a second or bottom arm 541. The first arm 538' comprises a first end 542' connected to the top retainer 532' and a second end 544' connected to the base wall 504'. The second arm 541 comprises a first end 546' connected to the bottom retainer 534' and a second end 548' connected to the base wall 504' of the C-channel 502'. The first and second arms 538', 541 extend rearward and are angled toward one another in the first position (not shown). The first and second arms 538', 541 extend rearward and are generally parallel to one another in the second position. As shown in FIG. 7, the second arm 541 has a length substantially the same as the first arm 538'.

It is to be appreciated that the C-channel 502' is not rearwardly inclined relative to vertical when in its operative position. The holder 500', due to its lack of inclination relative to vertical, is particularly adapted for a connection to an associated shelf at a viewer's eye level. Of course, those of ordinary skill in the art will recognize that the C-channel 502' can be arranged at a wide variety of other desired angles relative to vertical so that the C-channel 502' defines other viewing angles relative to vertical without departing from the overall scope and intent of the present invention.

Figure 8A:
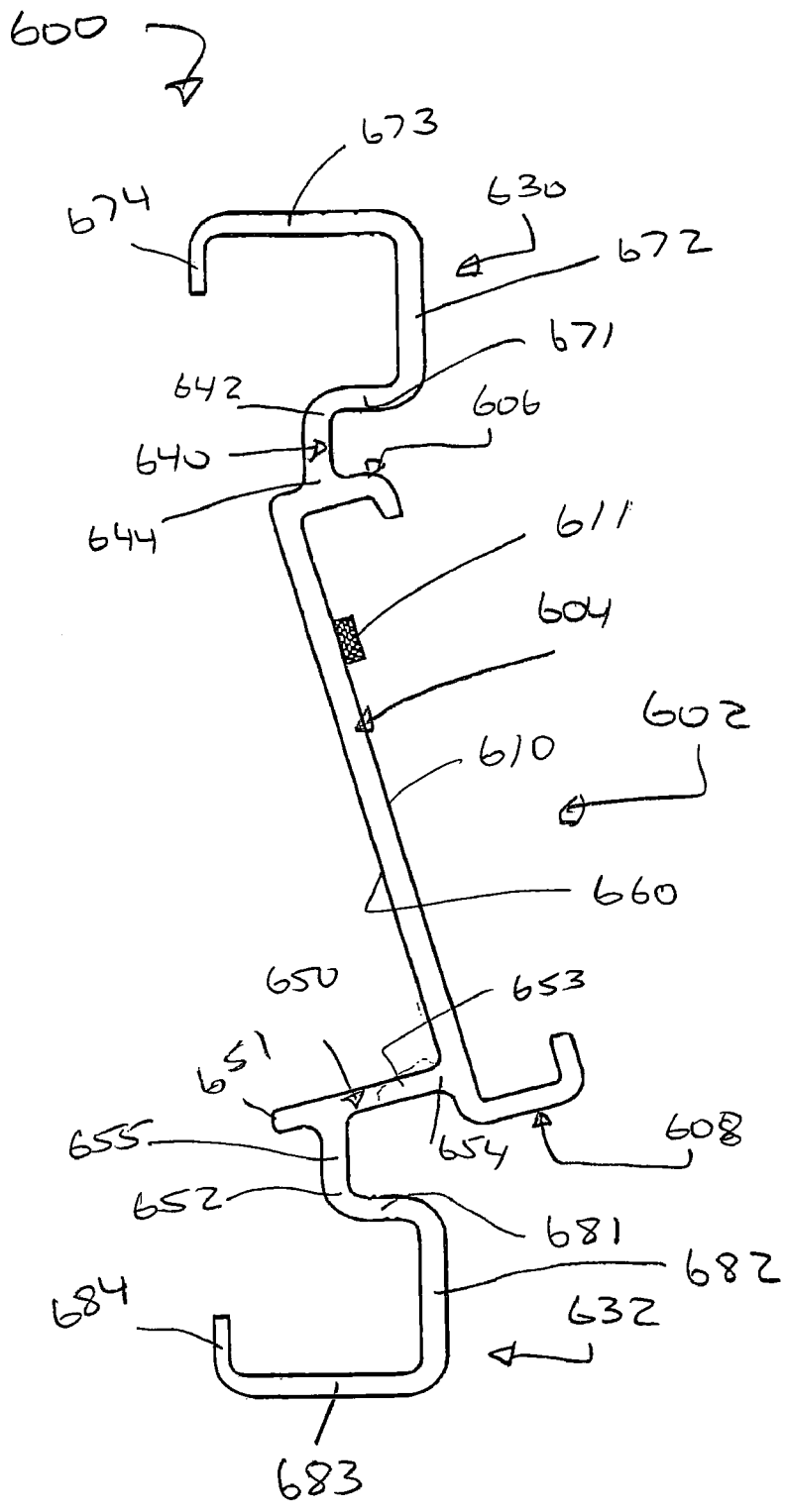
FIG. 8A is a side elevational view of a first version of a sixth type of holder for an EPL formed in accordance with the present invention.

With reference now to FIG. 8A, another holder for an electronic price label or the like is illustrated. A holder 600 includes a base channel 602 having an overall C-shaped configuration to slidably accommodate and frictionally retain an associated electronic price label. The C-channel 602 is defined by a base wall 604 which can be planar, and top and bottom walls 606, 608. A resilient strip 611 of a suitable conventional thermoplastic material is located proximal to top wall 606 and projects outwardly from the front face 610 of the base wall 604 to facilitate retention of an associated EPL.

The holder 600 further comprises a first clip 630 and a second clip 632 connected to the C-channel 602. The first and second clips 630, 632 are adapted to receive and retain therein spaced apart sections of an associated shelf S6 (FIG. 8B) or to a holder which is mounted to a shelf.

Figure 8B:
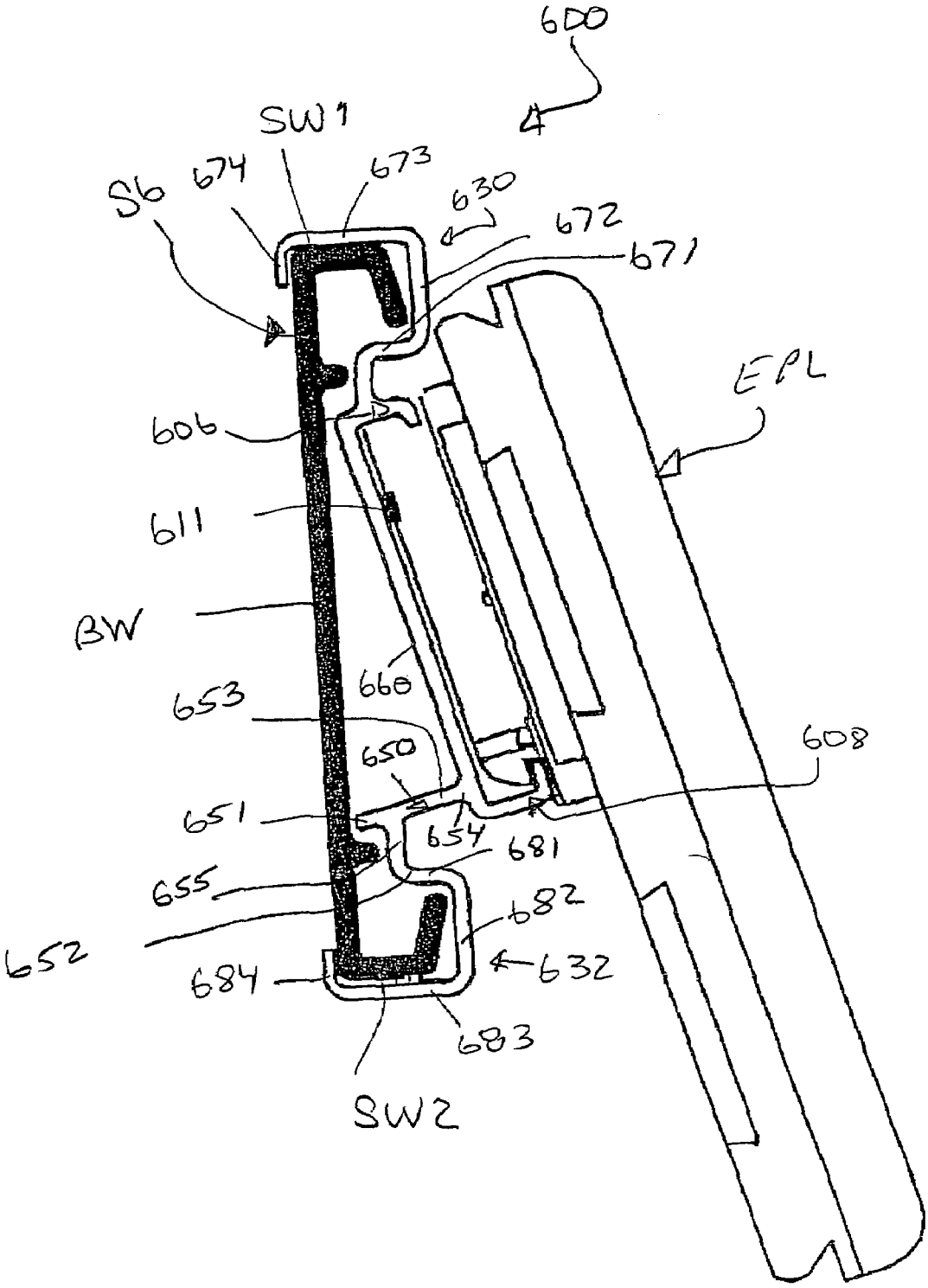
FIG. 8B is a side elevational view of the holder of FIG. 8A secured to a shelf as used to secure an associated EPL in an operative position; and, FIG. 9 is a side elevational view of a second version of the sixth type of EPL holder.

The first clip 630 and the C-channel 602 are resiliently interconnected by way of a first connecting arm 640. The first arm 640 comprises a first end 642 connected to the first clip member 630 and a second end 644 connected to the top wall 606 so that the first arm 640 is positioned above the top wall 606. The second clip 632 and the C-channel 602 are resiliently interconnected by way of a somewhat T-shaped second connecting arm 650. The second arm 650 comprises a first end 652 connected to the second clip member 632 and a second end 654 connected to the base wall 604 so that the second arm 650 is positioned behind the base wall 604 of the C-channel 602. As shown in FIG. 8B, the second arm 650 includes a protruding tip 651 which engages the back wall BW of the shelf S6 when the holder 600 is in its operative position thereby maintaining the desired inclination.

More particularly, the first connecting arm 640 projects generally upward from the top wall 606. The second connecting arm 650 includes a first segment 653 extending generally perpendicular from a rear face 660 of the base wall 604 and a second segment 655 extending generally downward.

The first clip 630 comprises a somewhat C-shaped resilient member having a forwardly extending first segment 671, an upwardly extending second segment 672, and a rearwardly extending third segment 673 including a hook end 674 thereon. Similarly, the second clip 632 comprises a somewhat C-shaped resilient member having a forwardly extending first segment 681, a downwardly extending second segment 682, and a rearwardly extending third segment 683 including a hook end 684 thereon. In its operative position the first and second clips 630,632 are adapted to receive and retain therein spaced apart first and second side walls SW1, SW2 of an associated shelf S6 (FIG. 8B).

The holder 600, due to its inclination relative to vertical, is particularly adapted for a connection to an associated shelf below a viewer's eye level. Of course, those of ordinary skill in the art will recognize that the C-channel 602 can be arranged at any other desired angle relative to the clips 630, 632 so that the C-channel 602 defines other viewing angles relative to vertical without departing from the overall scope and intent of the present invention. As seen in FIG. 8B, the C-channel is rearwardly inclined approximately 15 degrees relative to vertical when in its operative position.

Figure 9:
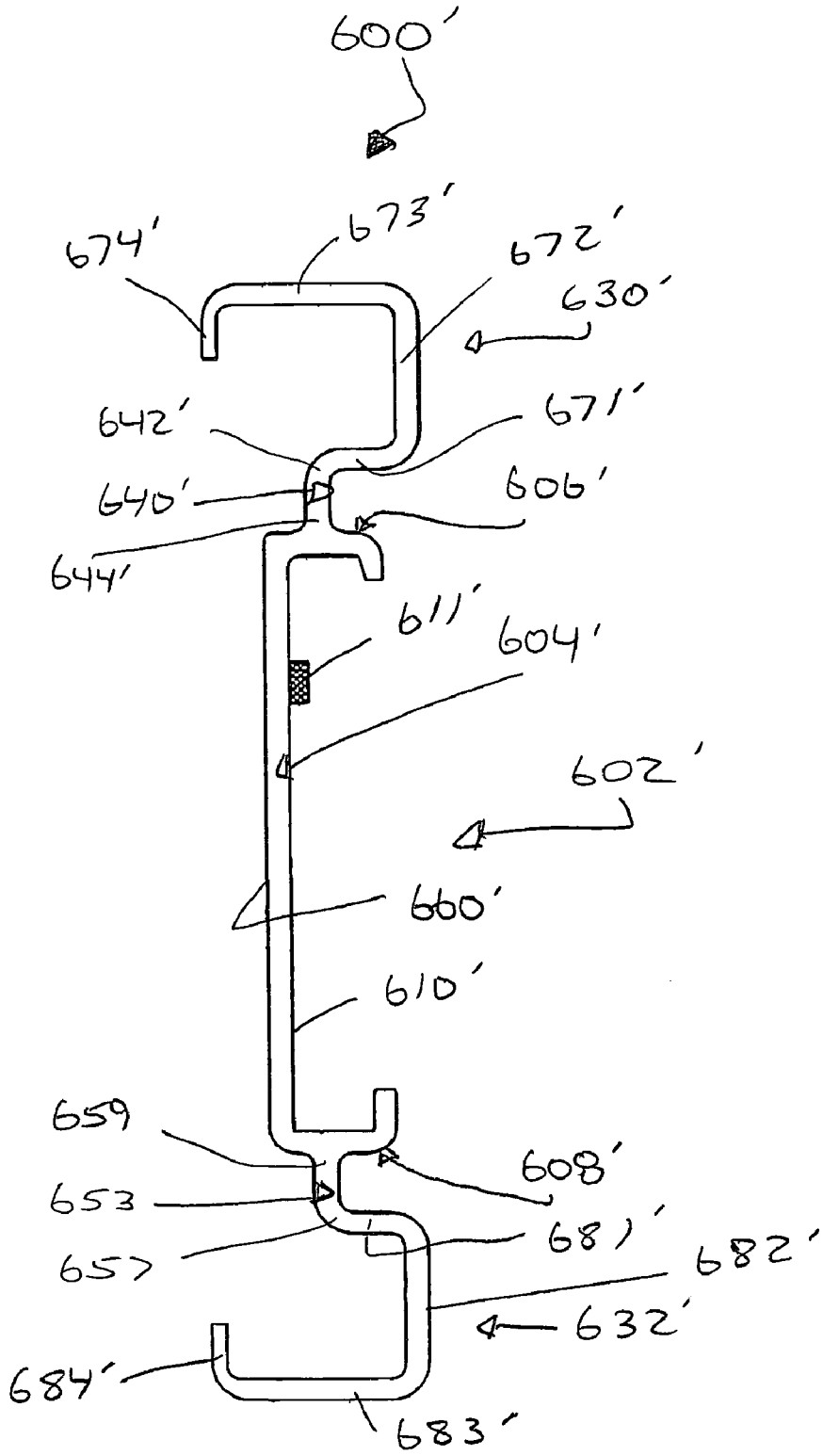

With reference now to FIG. 9, another holder for an electronic price label or the like is illustrated. For ease of comprehension, like components are identified by like components with a single-primed suffix (') and new components are identified by new numerals. A holder 600' includes a base channel 602' having an overall C-shaped configuration to slidably accommodate and frictionally retain an associated electronic price label. The C-channel 602' is defined by a base wall 604' which is preferably planar, and top and bottom walls 606', 608'.

The holder 600' further comprises a first clip 630' and a second clip 632' connected to the C-channel 602'. The first clip 630' and the second clip 632' are adapted to receive and retain therein spaced apart sections of an associated shelf S6 (see FIG. 8B).

The first clip 630' and the C-channel 602' are resiliently interconnected by way of a first connecting arm 640'. The first arm 640' comprises a first end 642' connected to the first clip member 630' and a second end 644' connected to the top wall 606' so that the first arm 640' is positioned above the top wall 606'. The second clip 632' and the C-channel 602' are resiliently interconnected by way of a second connecting arm 653. The second arm 653 comprises a first end 657 connected to the second clip member 632' and a second end 659 connected to the bottom wall 608' so that the second arm 653 is positioned below the bottom wall 608' of the C-channel 602'.

More particularly, the first connecting arm 640' projects generally upward from the top wall 606'. The second connecting arm 653 projects generally downward from the bottom wall 608'.

It is to be appreciated that the C-channel 602' is not rearwardly inclined relative to vertical when in its operative position. The holder 600', due to its lack of inclination relative to vertical, is particularly adapted for a connection to an associated shelf at a viewer's eye level. Of course, those of ordinary skill in the art will recognize that the C-channel 602' can be arranged at any other desired angle relative to vertical so that the C-channel 602' defines other viewing angles relative to vertical without departing from the overall scope and intent of the present invention.

Disclosed is a holder for an electronic price label which is sturdy, durable, and cost effective to manufacture. The holder is adapted for secure, selective attachment to a wide variety of different retail shelving types. The holder is provided in a plurality of different configurations, each of which supports an electronic price label at a desired viewing angle relative to an associated shelf so that the supported electronic price label may be viewed at an optimal viewing angle for a given shelf height. The holder also provides for selective securement of a protective viewing lens. Additionally, the holder includes a clip adapted for selective attachment of advertising or other materials thereto. If desired, protective lenses can be used to selectively receive and retain associated tags, cards, or like material to be viewed in association with the information displayed on the electronic price label.

The invention has been described with reference to several preferred embodiments. Obviously, alterations and modifications will occur to others upon a reading and understanding of this specification. It is intended to include all such modifications and alterations insofar as they come within the scope of the appended claims or the equivalents thereof.

Having thus described the invention, it is claimed:

1. A holder for an electronic price label, said holder comprising:

a channel member defined by a base wall and first and second spaced-apart side walls that project outwardly from opposite ends of said base wall with respective first and second inner faces arranged for selectively accommodating an associated electronic price label;

a connector mounted to a back face of said channel member, said connector including a clip member adapted to receive and retain therein a projecting portion of an associated retail shelf, said clip member comprising:

a first leg and a second leg, said first leg includes a first segment projecting towards said second leg and a second segment extending away from said second leg, said second leg includes a first segment projecting away from said channel member base wall and a second segment, and, said first leg and said second leg cooperating to define an upwardly open slot including a relatively narrow open end and a relatively wider closed end; and, wherein said connector further comprises a first connecting arm and a second connecting arm, said first arm having a first end connected to said base wall and a second end, said second arm having a first end connected to said base wall and a second end.

2. The holder as set forth in claim 1, wherein said connector further comprises a back wall.

3. The holder as set forth in claim 1, further comprising a first leg extending away from said first arm and a second leg extending away from said second arm.

4. A holder for an electronic price label, said holder comprising:

a channel member defined by a base wall and first and second spaced-apart side walls that project outwardly from opposite ends of said base wall with respective first and second inner faces arranged for selectively accommodating an associated electronic price label;

a mounting portion connected to said channel member, said mounting portion comprising:

a clip member adapted to receive and retain therein a projecting portion of a mounting wall of an associated retail shelf wherein said clip member comprises a first member and a second member, and a connecting member comprising;

a back wall, a first connecting arm, and a second connecting arm, said first arm having a first end connected to said channel member and a second end connected to said back wall, said second arm having a first end connected to said channel member and a second end connected to said back wall; and, wherein said clip member is located on a first side of said back wall and said first and second connecting arms are located on a second side of said back wall.

5. The holder as set forth in claim 4, wherein said first member is connected to said second member at a bend.

6. The holder as set forth in claim 4, wherein said first connecting arm comprises an L-shaped member comprising a first segment and a second segment extending therefrom.

7. The holder as set forth in claim 4, further comprising a transparent lens selectively positioned in covering relation with said base wall of said channel, said lens including a viewing wall, and first and second side walls projecting outwardly from said viewing wall, said first and second side walls of said lens each define a projection adapted for selective receipt in open slots adjacent said base wall.

8. The holder as set forth in claim 7, wherein said lens comprises a living hinge along said first side wall of said lens whereby said viewing wall adapted for movement between an open position, wherein said viewing wall extends away from said base wall of said channel member, and a closed position, wherein said viewing wall is placed in covering spaced relation with said channel member.

9. The holder as set forth in claim 7, wherein said second side wall projection further comprises an upwardly projecting resilient finger defining a selectively closed slot for insertion of printed material.

10. A holder for an electronic price label, said holder comprising:

a channel member defined by a base wall and first and second spaced-apart side walls that project outwardly from opposite ends of said base wall with respective first and second inner faces arranged for selectively accommodating an associated electronic price label;

a clip member adapted to receive and retain therein a projecting portion of a mounting wall of an associated retail shelf wherein said clip member comprises:

a first leg for contacting a first side of the projecting portion of the associated retail shelf, said first leg includes a first segment projecting rearwardly and a second segment extending upwardly from said first segment, and a second leg for contacting a second side of the same projecting portion of the associated retail shelf, said second leg includes a first segment projecting rearwardly and a second segment extending upwardly from said first segment, wherein said first and second legs cooperate to define an upwardly open slot including a relatively narrow open end and a relatively wider closed end; and, a connecting member mounted for connecting said clip member to said channel member wherein said connecting member comprises a first arm connected at a first end to said channel member and connected at a second end to said clip member.

11. The holder as set forth in claim 10, further comprising a document holder defined between said clip member and said base wall.

12. The holder as set forth in claim 11, wherein said document holder comprises a resilient finger and a nib defining a selectively closed slot therebetween.

13. The holder as set forth in claim 10, wherein said base wall includes a front face including a strip of resilient material projecting outwardly therefrom.

14. The holder as set forth in claim 10 wherein said connecting member further comprises a second arm spaced from said first arm.

15. The holder as set forth in claim 14 wherein said second arm comprises a first end connected to said channel member and a second end connected to said clip member.

16. A holder for an electronic price label, said holder comprising:

a channel member defined by a base wall and first and second spaced apart side walls that project outwardly from opposite ends of said base wall, said channel member selectively accommodating an associated electronic price label;

a connector mounted to said channel member, said connector comprising;

a clip defining a somewhat C-shaped body and comprising interconnected walls including wall segments that project toward each other and cooperate to define a relatively narrow open end and a relatively wider closed end for receiving and retaining a projecting portion of an associated retail shelf, a first arm connected between said clip and said channel member, and a second arm, spaced from said first arm, connected between said clip and said channel member, said first arm is somewhat L-shaped in cross section and includes a first segment and a second segment.

17. The holder as set forth in claim 16, wherein said channel member base wall includes a front face having a strip of resilient material projecting outwardly therefrom.

18. The holder as set forth in claim 16, wherein said connector further comprises a back wall, said first arm having a first end connected to said channel member base wall, a second end connected to said back wall, said second arm having a first end connected to said base wall and a second end connected to said back wall.

19. The holder as set forth in claim 16 further comprising a finger mounted to said base wall.

20. The holder as set forth in claim 19 further comprising a nib extending from said base wall and cooperating with said finger.

21. A holder for an electronic price label, said holder comprising:

a channel member defined by a base wall and first and second spaced apart side walls that project outwardly from opposite ends of said base wall, said channel member selectively accommodating an associated electronic price label;

a connector of one piece with said channel member, said connector comprising:

a clip comprising interconnected walls including wall segments which define a base wall and a pair of wall segments that project toward each other and cooperate to define a relatively narrow upwardly facing open end and a relatively wider closed end for receiving and retaining a projecting portion of an associated retail shelf, and a first arm connected at a first end to said clip and at a second end to said channel member; and a finger mounted to said base wall of the clip.

22. The holder as set forth in claim 21, wherein said base wall includes a front face including a strip of resilient material projecting outwardly therefrom.

23. The holder as set forth in claim 21 wherein said first arm is somewhat L-shaped in cross section and includes a first segment and a second segment.

24. The holder as set forth in claim 21 further comprising a nib extending from said base wall and cooperating with said finger.

* * * * *